United States Patent [19]

Ingle

[11] Patent Number: 4,938,628

[45] Date of Patent: Jul. 3, 1990

[54] SYSTEM FOR MOVING DRILLING MODULE TO FIXED PLATFORM

[75] Inventor: James E. Ingle, Edmond, Okla.

[73] Assignee: Transworld Drilling Company, Oklahoma City, Okla.

[21] Appl. No.: 429,728

[22] Filed: Oct. 31, 1989

[51] Int. Cl.[5] ..... E02B 17/00

[52] U.S. Cl. ..... 405/201; 405/203; 405/196; 414/662

[58] Field of Search ..... 405/196, 201, 203, 204, 405/206, 209; 114/265; 414/277, 280, 282, 659, 660, 661, 662

[56] References Cited

U.S. PATENT DOCUMENTS

| | | | |
|---|---|---|---|
| 1,894,950 | 1/1933 | Fitch | 414/383 |
| 2,489,862 | 11/1949 | Dunn | 381/158 |
| 2,644,971 | 7/1953 | Rowe | 14/71.7 |
| 2,934,905 | 5/1960 | Woolslayer et al. | 405/209 |
| 2,959,015 | 11/1960 | Beck | 405/209 |
| 2,997,852 | 4/1961 | Suderow | 405/209 |
| 3,011,318 | 12/1961 | Ashton | 405/209 |
| 3,033,525 | 5/1962 | Johnson | 405/201 X |
| 3,150,787 | 9/1964 | Patrignani | 414/273 X |
| 3,448,511 | 6/1969 | Suter | 405/228 X |
| 3,477,235 | 11/1969 | Branham et al. | 405/203 X |
| 3,716,993 | 2/1973 | Summer | 405/198 |
| 3,931,778 | 1/1976 | Miller | 114/26 |
| 3,952,887 | 4/1976 | Lutz | 414/392 |
| 4,103,503 | 8/1978 | Smith | 405/196 |
| 4,583,881 | 4/1986 | Steele | 405/203 X |
| 4,602,894 | 7/1986 | Lorenz et al. | 405/203 |

*Primary Examiner*—Dennis L. Taylor
*Assistant Examiner*—Arlen L. Olsen
*Attorney, Agent, or Firm*—Herbert M. Hanegan

[57] ABSTRACT

A jack-up rig includes a cantilever beam assembly and a drilling module is mounted on the cantilever beam assembly. The jack-up rig also includes means for moving the cantilever beam assembly from the storage position to extended positions wherein a rearward end of the cantilever beam assembly is extended from the jack-up rig. The fixed platform comprises a fixed platform support structure having a drilling module support surface and a beam opening. The jack-up rig is positioned near the fixed platform with the cantilever beam assembly generally aligned with the beam opening in the fixed platform support structure. The cantilever beam assembly then is extended through a portion of the beam opening to an extended position wherein the drilling module is supported on the cantilever beam assembly a distance generally above the drilling module support surface. The jack-up rig then is lowered to a position wherein the drilling module is supported on the fixed platform support structure. The cantilever beam assembly then is withdrawn from the beam opening and moved to the storage position thereby leaving the drilling module supported on the drilling module support surface of the fixed platform support structure. A bridge is movably connected to the fixed platform and the jack-up rig. A floor is removably supported on the cantilever beam assembly generally below the drilling module.

31 Claims, 21 Drawing Sheets

SYSTEM FOR MOVING DRILLING MODULE TO FIXED PLATFORM

FIELD OF THE INVENTION

The present invention relates generally to methods and apparatus for transferring a drilling module from a jack-up rig to a fixed platform wherein the drilling module is supported on a cantilever beam assembly and the cantilever beam assembly with drilling module supported thereon is moved to an extended position generally over the fixed platform and the drilling module is removed from the cantilever beam assembly and supported on the fixed platform.

DESCRIPTION OF THE PREFERRED EMBODIMENTS

Figure 1:
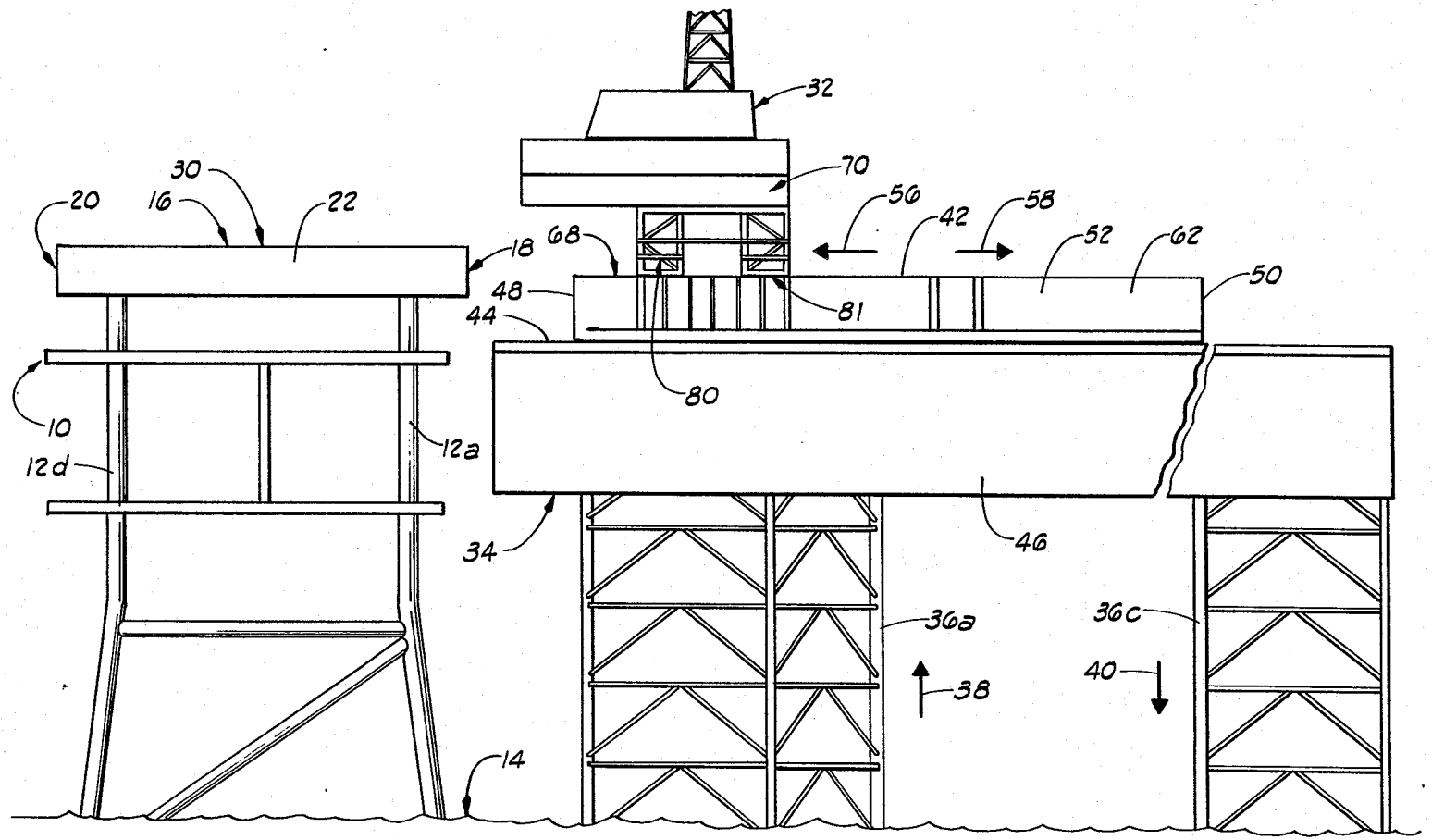
FIG. 1 is a side elevational, diagrammatic view of a fixed platform and a jack-up rig showing a drilling module supported on a cantilever beam assembly on the jack-up rig.
Figure 2:
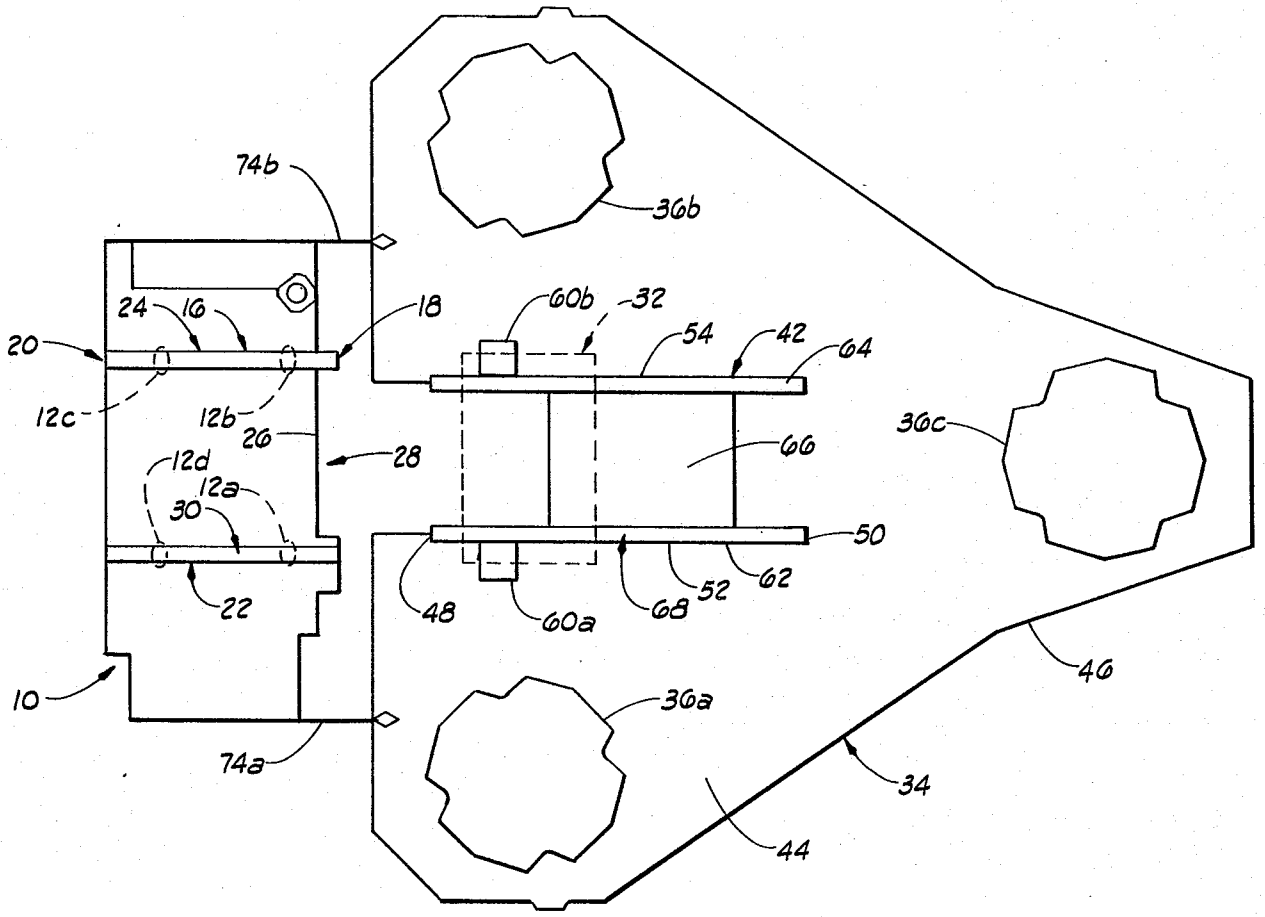
FIG. 2 is a top plan, diagrammatic view of the fixed platform and the jack-up rig shown in FIG. 1, with the drilling module being shown in outline form in dashed lines.
Figure 3:
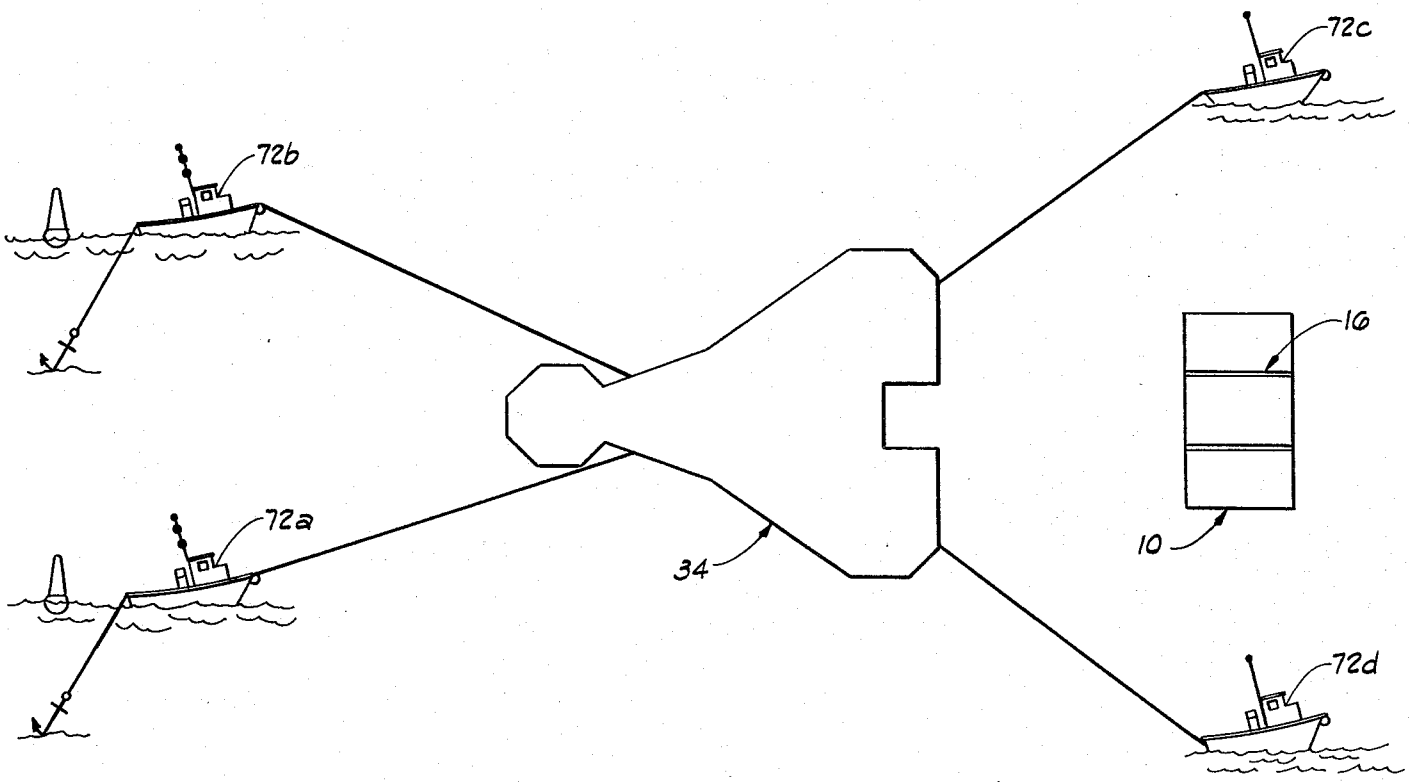
FIG. 3 is a diagrammatic view showing one step in the positioning of the jack-up rig near the fixed platform, the cantilever beam assembly and the drilling module not being shown.

Shown in FIGS. 1 and 2 is a fixed platform 10 having a plurality of legs 12 (four legs being shown in dashed lines in FIG. 2 and designated therein by the reference numerals 12*a*, 12*b*, 12*c* and 12*d*) which extend into and are secured in an ocean floor 14. A fixed platform support structure 16 is connected to the legs 12 of the fixed platform 10. The fixed platform support structure 16 has a front end 18, a rear end 20, a first side 22 and a second side 24. The first side 22 is spaced a distance 26 (FIG. 2) from the second side 24.

A beam opening 28 (FIG. 2) is formed in the fixed platform support structure 16. The beam opening 28 extends through the front end 18 and extends a distance generally toward the rear end 20 of the fixed platform support structure 16.

A drilling module support surface 30 is formed on the fixed platform support structure 16. The drilling module support surface 30 is positioned and adapted to supportingly receive a drilling module 32 (partially shown in FIGS. 1, 7, 8 and 9 and shown in outline form in dashed lines in FIGS. 2 and 6) in a manner to be described in more detail below.

Also shown diagrammatically in FIGS. 1 and 2 is a jack-up rig 34. The jack-up rig 34 has a plurality of telescoping legs 36 (three legs 36 being shown in FIGS. 1 and 2 and designated therein by the reference numerals 36*a*, 36*b* and 36 *c*). The legs 36 are movable in an upwardly direction 38 and in a downwardly direction 40, as shown in FIG. 1.

A cantilever beam assembly 42 is movably supported on an upper surface 44 of a hull 46 portion of the jack-up rig 34. The cantilever beam assembly 42 has a rearward end 48, a forward end 50, a first side 52 and a second side 54. The cantilever beam assembly 42 is movably supported on the upper surface 44 for movement in a direction 56 (FIGS. 1, 7, 8 and 9) generally toward extended positions wherein the rearward end 48 is extended distances outwardly from the jack-up rig 34 and in a direction 58 (FIGS. 1, 7, 8 and 9) generally from extended positions (shown in FIGS. 7 and 8) to a storage position (shown in FIGS. 1, 2, 3, 4, 5, 6 and 9) wherein the entire cantilever beam assembly 42 is disposed on the upper surface 44 of the jack-up rig 34.

Figure 6:
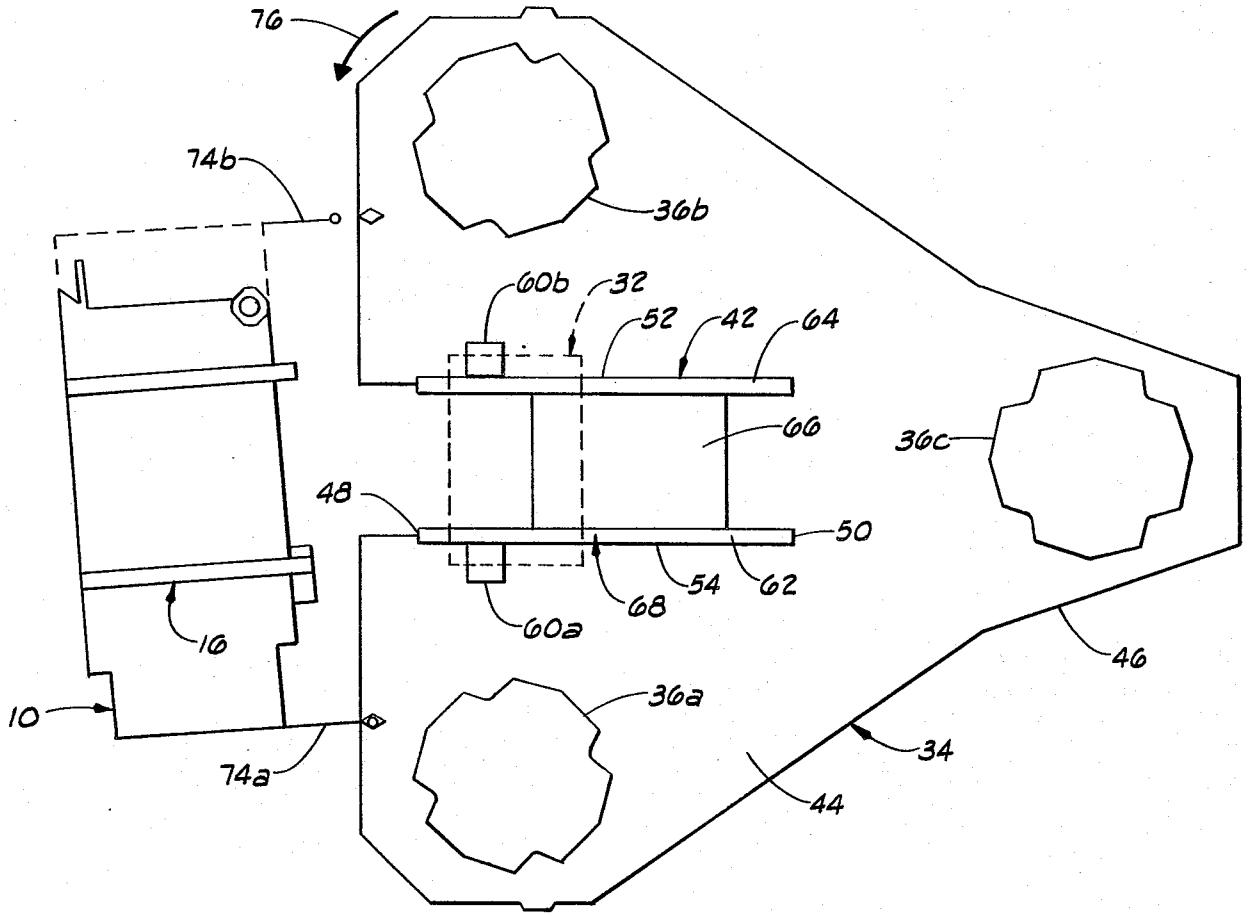
FIG. 6 is a diagrammatic view showing still another step in the positioning of the jack-up rig near the fixed platform.

A beam moving assembly 60 is associated with the cantilever beam assembly 42. The beam moving assembly 60 is adapted to move the cantilever beam assembly 42 in the directions 56 and 58. As shown in FIG. 6, the beam moving assembly 60 in one embodiment comprises two portions designated by the reference numerals 60*a* and 60*b*.

Offshore fixed platforms like the fixed platform 10 without the fixed platform support structure 16 are well-known in the art and a detailed description of the construction and operation is not deemed necessary. Jack-up rigs like the jack-up rig 34 described above also are well known in the art. Such prior art jack-up rigs commonly include a cantilever beam assembly like the cantilever beam assembly 42 with a beam moving assembly like the beam moving assembly 60. A detailed description of the construction and operation of such a jack-up rig or the cantilever beam assembly or beam moving assembly portions thereof is not deemed necessary herein.

The cantilever beam assembly 42, more particularly, comprises a first cantilever beam 62 (FIGS. 2 and 6) and a second cantilever beam 64 (FIGS. 2 and 6) with a support plate 66 (FIGS. 2 and 6) disposed between the first and the second cantilever beams 62 and 64. One end of the support plate 66 is connected to the first cantilever beam 62 and the opposite end of the support plate 66 is connected to the second cantilever beam 64. The upper surface of the cantilever beam assembly 42 formed by the upper surface of the first and the second cantilever beams 62 and 64 forms a beam support surface 68.

The first cantilever beam 62 forms the first side 52. The second cantilever beam 64 forms the second side 54. The rearward ends of the cantilever beams 62 and 64 form the rearward end 48. The forward ends of the cantilever beams 62 and 64 forms the forward end 50. In one form, portion 60*a* of the beam moving assembly 60 comprises a geared track connected to the first cantilever beam 62 and extending a distance outwardly therefrom. The geared track extends a distance generally between the forward end and the rearward end of the first cantilever beam 62.

The drilling module 32 is supported on the beam support surface 68 of the cantilever beam assembly 42. More particularly, a drilling module substructure 70 is connected to the lower end of the drilling module 32 and the drilling module substructure 70 is supported on the beam support surface 68 of the cantilever beam assembly 42.

In many instances, it is necessary to transfer a drilling module to a fixed platform for drilling or reworking an offshore oil or gas well. The present invention particularly is directed to a convenient method for transferring the drilling module 32 to the fixed platform 10 and for removing the drilling module 32 from the fixed platform 10.

Figure 4:
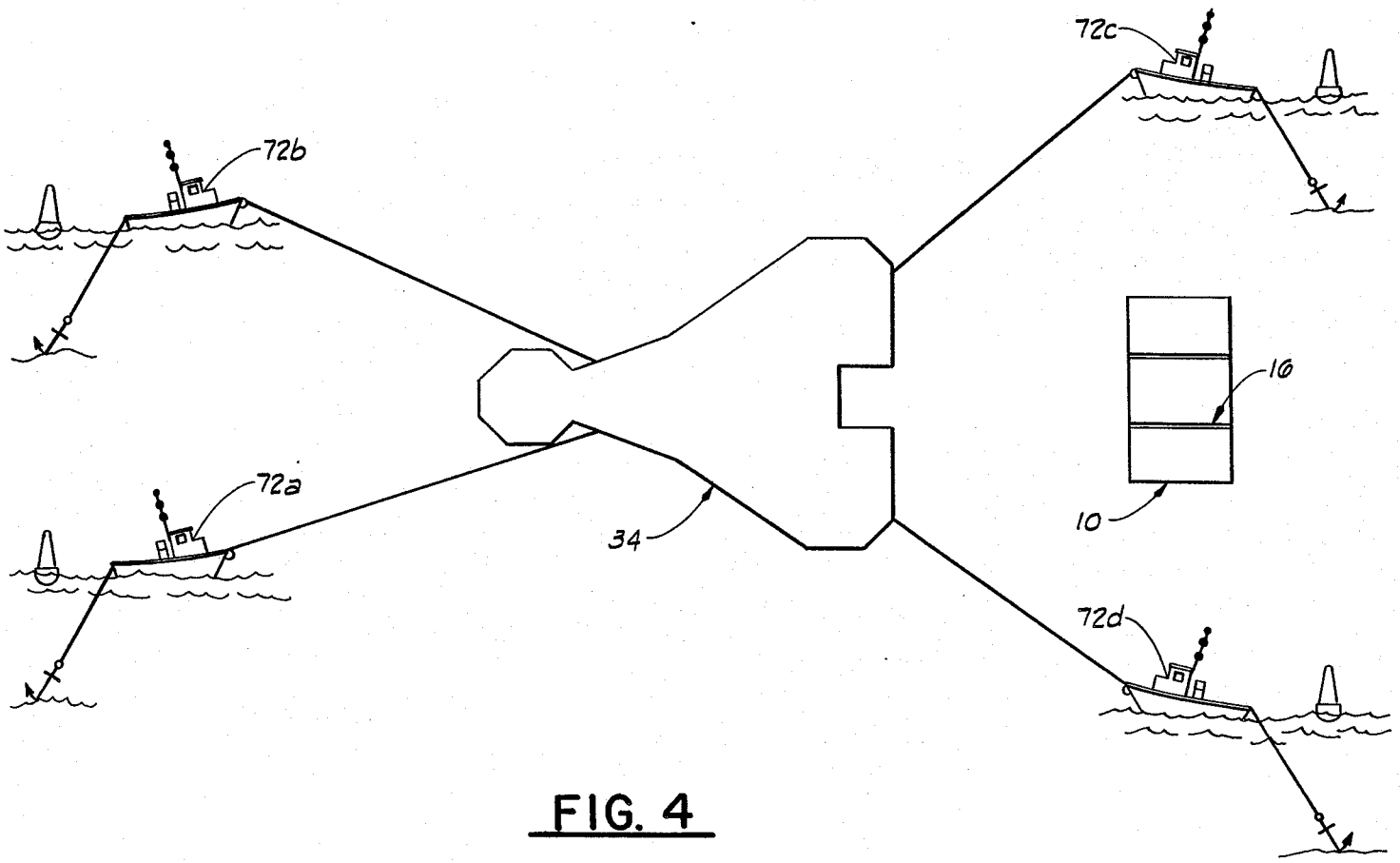
FIG. 4 is a diagrammatic view showing one other step in the positioning of the jack-up rig near the fixed platform, the cantilever beam assembly and the drilling module not being shown.

In operation, the legs 36 of the jack-up rig 34 are moved in the upwardly direction 38 to a storage position so that the hull 46 of the jack-up rig 34 is floatingly supportable on the ocean surface. In this position, the jack-up rig 34 is towed by a plurality of boats 72 (four boats 72 being shown in FIGS. 3–5 and designated therein by the reference numerals 72*a*, 72*b*, 72*c* and 72*d*) to a position wherein the jack-up rig 34 is disposed near the fixed platform 10. In this initial position (shown in FIG. 3), the bow anchors are set by anchoring the boats 72*a* and 72*b*. Then, the port and starboard anchors are set by anchoring the boats 72*c* and 72*d*, as illustrated in FIG. 4. After the bow anchor and the port and starboard anchors have been set, the jack-up rig 34 is moved to a position generally near the fixed platform 10 to a position wherein the cantilever beam assembly 42 is generally aligned with the beam opening 28 in the fixed platform support structure 16 on the fixed platform 10, as illustrated in FIG. 5.

Figure 5:
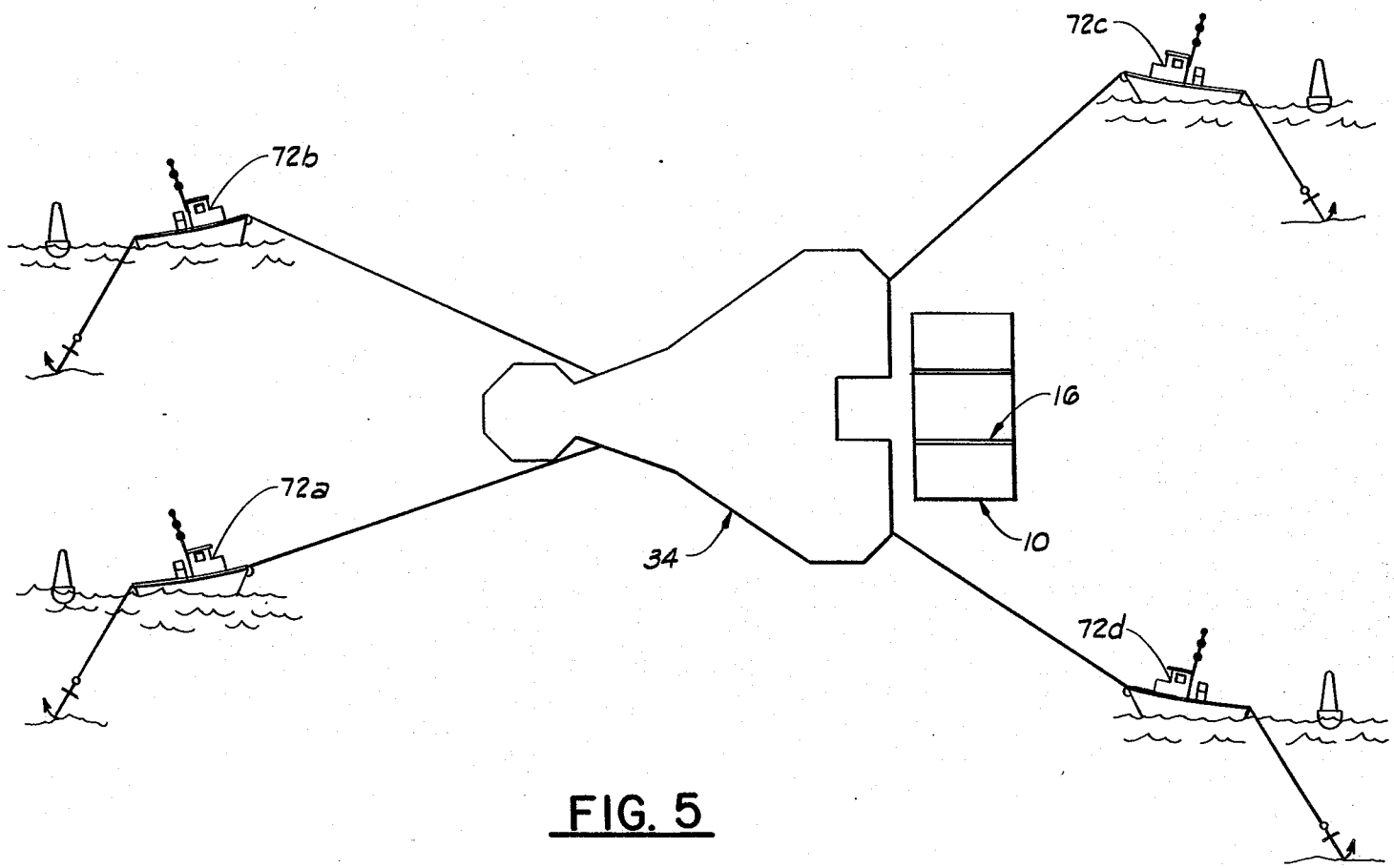
FIG. 5 is another diagrammatic view showing yet another step in the positioning of the jack-up rig near the fixed platform, the cantilever beam assembly and the drilling module not being shown.

When the jack-up rig 34 has been floatingly positioned near the fixed platform 10, as shown in FIG. 5, the leg 36*a* is lowered and engaged and set in the ocean floor 14. The jack-up rig 34 then is rotated in a direction 76 (FIG. 6) to a position wherein the cantilever beam assembly 42 is generally aligned with the beam opening 28 in the fixed platform support structure 16, as illustrated in FIG. 2.

As illustrated in FIGS. 2 and 6, lasers suspended from supports 74*a* and 74*b* supported on the fixed platform 10 are alignable with predetermined positions on jack-up rig 34 for assisting in aligning the jack-up rig 34 in a predetermined position with respect to the fixed platform 10. Other forms of alignment assist means may be used in a particular application.

In the this position of the jack-up rig 34 and fixed platform 10, the other two legs 36*b* and 36*c* of the jack-up rig 34 are lowered and engaged in the ocean floor 14. In this position, the legs 36 support the hull 46 from the ocean floor 14.

In this position of the jack-up rig 34 and the fixed platform 10, shown in FIGS. 1 and 2, the jack-up rig 34 platform is moved in the upwardly direction 38 or the downwardly direction 40 as shown in FIG. 1 to a position wherein a lower substructure support surface 80 on the drilling module 32 (more particularly, the drilling module substructure 70) is disposed in a horizontal plane spaced a distance generally above a horizontal plane in which the drilling module support surface 30 is disposed. In this position, the beam moving assembly 60 is actuated or activated to move the cantilever beam assembly 42 with the drilling module 32 supported thereon in a direction 56 generally outwardly and away from the jack-up rig 34 and generally toward the fixed platform 10.

The beam opening 28 in the fixed platform support structure 16 is sized to receive and accommodate a portion of the cantilever beam assembly 42 generally near the rearward end 48 thereof. The cantilever beam assembly 42 is moved in the direction 56 to a position wherein a portion of the cantilever beam assembly 42 generally near the rearward ed 48 thereof is disposed within a portion of the beam opening 28 and the lower substructure support surface 80 is disposed generally above the drilling module support surface 30 on the fixed platform support structure 16, as shown in FIG. 7.

Figure 7:
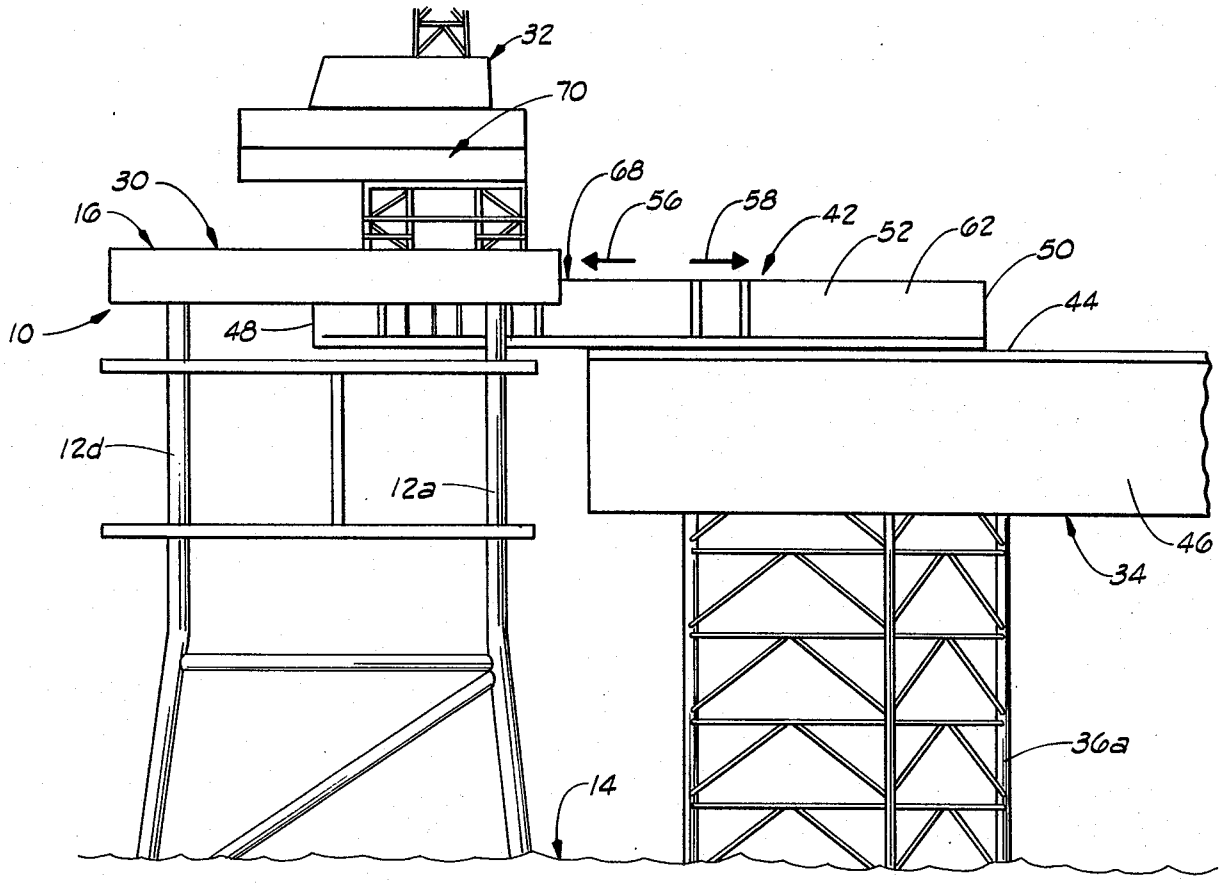
FIG. 7 is a diagrammatic, side elevational view showing the cantilever beam extended from the jack-up rig for positioning the drilling module on the fixed platform.
Figure 8:
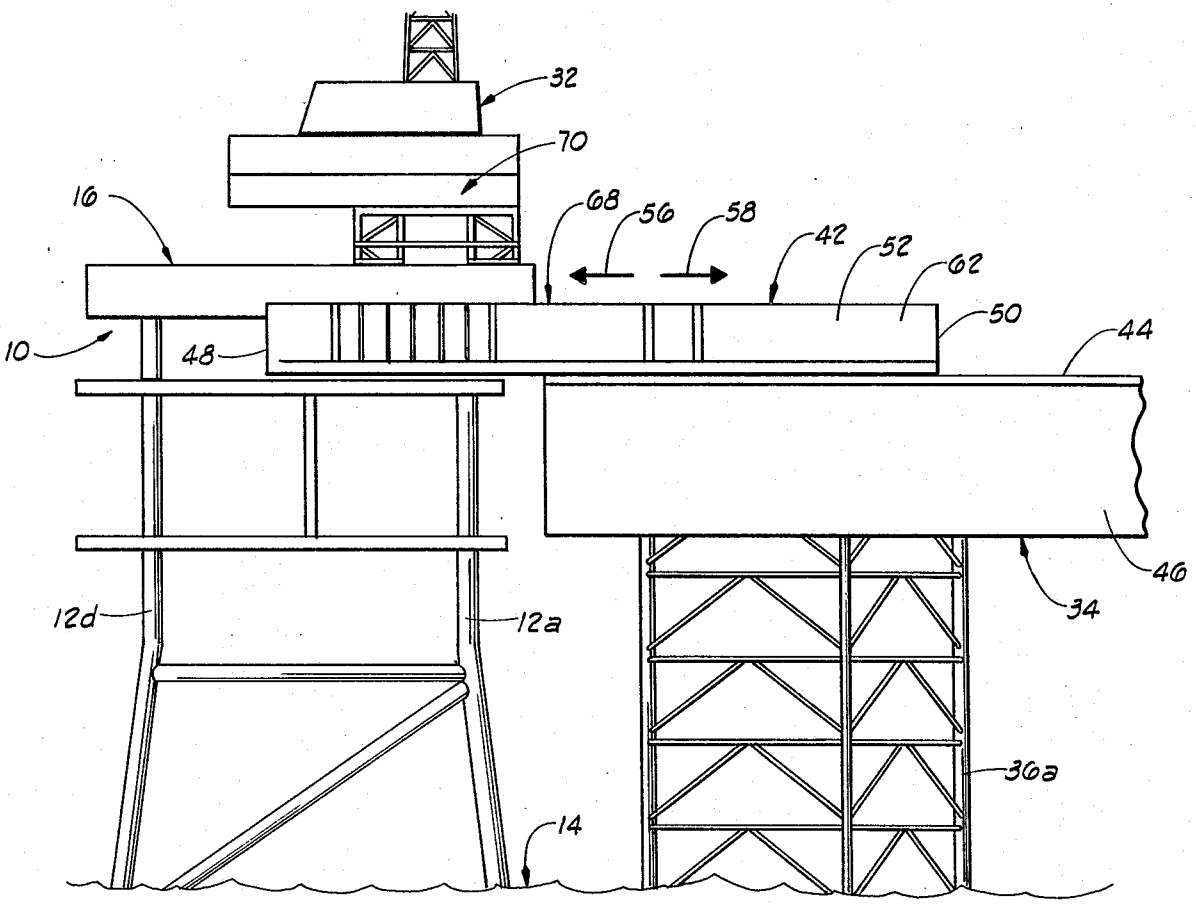
FIG. 8 is a sectional view of FIG. 7, side elevational view showing the cantilever beam assembly lowered, as compared to the position of the cantilever beam assembly shown in FIG. 7, and showing the drilling module disposed on the fixed platform.

When the cantilever beam assembly 42 with the drilling module 32 supported thereon is positioned as illustrated in FIG. 7, the jack-up rig 34 platform is moved further in the downwardly direction 40 thereby lowering the cantilever beam assembly 42 to a position illustrated in FIG. 8. As the cantilever beam assembly 42 is lowered in the downwardly direction 40, the lower substructure support surface 80 engages the drilling module support surface 30 on the fixed platform support structure 16 and the drilling module 32 is transferred to the fixed platform support structure 16 with the lower substructure support surface 80 of the drilling module 32 being supported generally on the drilling module support surface 30 of the fixed platform support structure 16.

Figure 9:
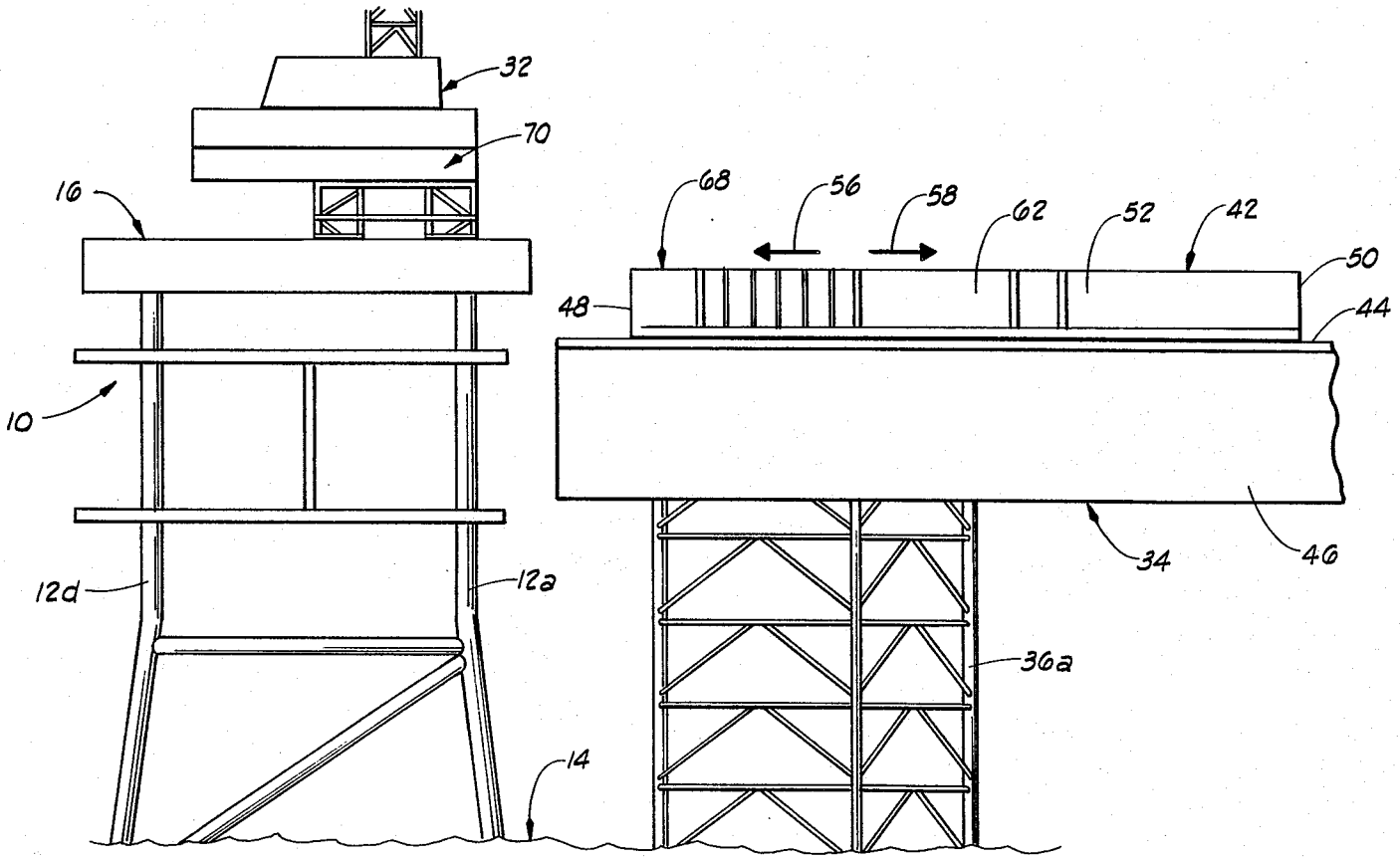
FIG. 9 is a diagrammatic, side elevational view showing the cantilever beam assembly withdrawn from the fixed platform and moved back to the storage position after disposing the drilling module on the fixed platform.

After the drilling module 32 has been transferred to the fixed platform support structure 16, the beam moving assembly 60 is activated to move the cantilever beam assembly 42 in the direction 58 thereby moving the cantilever beam assembly 42 to the storage position. In this position, as illustrated in FIG. 9, the cantilever beam assembly 42 is in the storage position and the drilling module 32 has been transferred to the fixed platform 10 supported on the fixed platform support structure 16.

The jack-up rig 34 platform is moved further in a downwardly direction 40 to a position convenient to transfer drilling materials from the removeable floor assembly 160 to the drilling module substructure 70 over the dragway bridge assembly 200.

To remove the drilling module 32 from the fixed platform 10, the process just described is reversed. The jack-up rig 34 is positioned to align the cantilever beam assembly 42 with the beam opening 28. The cantilever beam assembly 42 then is extended into the beam opening 28 generally under the drilling module 32. The jack-up rig 34 platform then is elevated or moved in the upwardly direction 38 so that the beam support surface 68 of the cantilever beam assembly 42 engages a lower beam support surface 81 and the drilling module 32 is lifted from the fixed platform support structure 16. After the drilling module 32 has been positioned on the cantilever beam assembly 42, the beam moving assembly 60 activated to move the cantilever beam assembly 42 in the direction 58 to the storage position on the jack-up rig 34.

Figure 10:
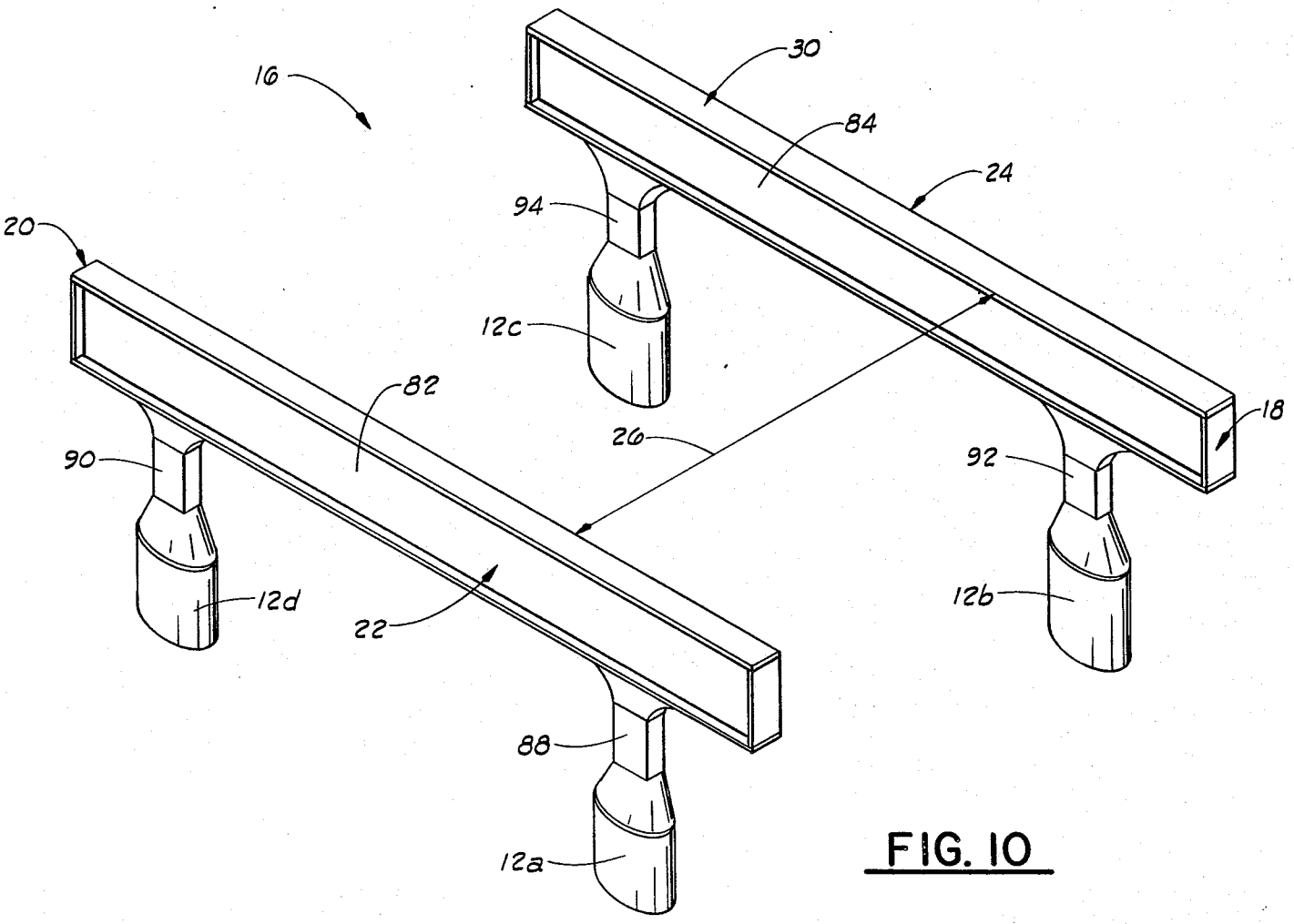
FIG. 10 is a partial perspective view of the fixed platform support structure which is connected to the fixed platform and adapted to support the drilling module.

Shown in FIG. 10 is a perspective view of the fixed platform support structure 16. The fixed platform support structure 16 comprises a first beam 82 and a second beam 84. The first beam 82 forms the first side 22 and the second beam 84 forms the second side 24 of the fixed platform support structure 16. The front ends of the beams 82 and 84 form the front end 18. The rear ends of the beams 82 and 84 form the rear end 20.

The beams 82 and 84 are spaced the distance 26 apart. The upper sides of the beams 82 and 84 cooperate to form the drilling module support surface 30.

It should be noted that the distance 26 could be sized so that one of the cantilever beams 62 extends on the outside of beam 82 and the other cantilever beam 64 extends on the outside of the beam 84 when the cantilever beams 62 and 64 are positioned in the beam opening 28 for disposing the drilling module 32 on the fixed platform support structure 16. In this instance, the drilling module substructure 70 would be modified to cooperate in transferring the drilling module 32 to the fixed platform support structure 16. The beam opening 26 would include one portion on one side of the beam 82 and another portion on one side of the beam 84.

One end of a first leg 88 is connected to the first beam 82, generally near the front end 18. The opposite end of the first leg 88 is connected to the leg 12*a* of the fixed platform 10.

One end of a second leg 90 is connected to the first beam 82, generally near the rear end 20. The opposite end of the second leg 90 is connected to the leg 12*d* of the fixed platform 10.

One end of a third leg 92 is connected to the second beam 84, generally near the front end 18. The opposite end of the third end 92 is connected to the leg 12*b* of the fixed platform 10.

One end of a fourth leg 94 is connected to the second beam 84, generally near the rear end 20. The opposite end of the fourth leg 94 is connected to the leg 12*c* of the fixed platform 10.

The space between the first and the second beams 82 and 84 cooperates to form the beam opening 28. The beam opening 28 also extends from the beams 82 and 84 downwardly and a portion of the fixed platform 10 generally between the legs 12*a* and 12*b* also cooperates to form a portion of the beam opening 28. As mentioned before, the beam opening 28 and the distance 26 are sized so that the cantilever beam assembly 42 with the drilling module 32 positioned thereon can be passed into and a distance through the beam opening 28 in the directions 56 and 58.

Figure 11:
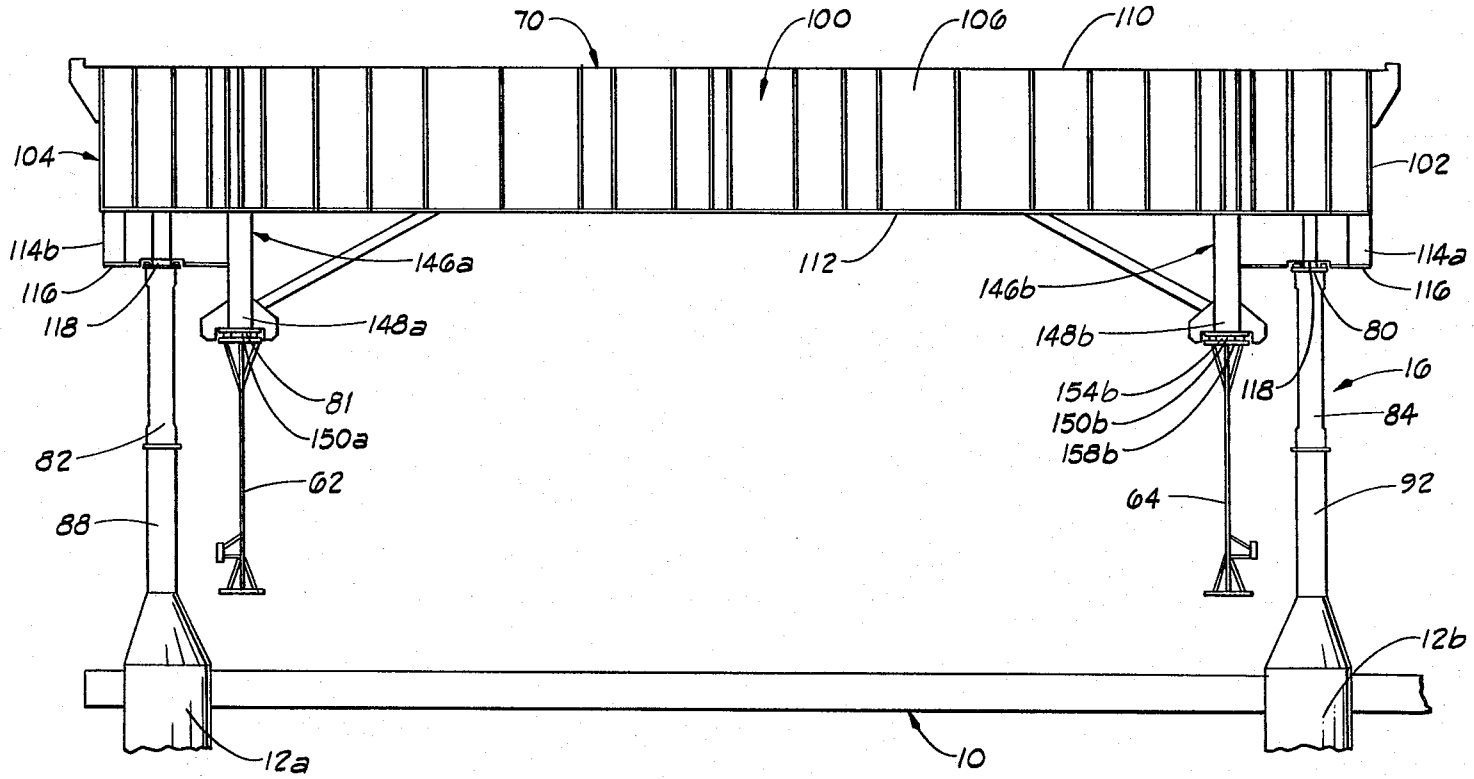
FIG. 11 is an end elevational view showing the drilling module substructure supported on the cantilever beam assembly and positioned in the fixed platform support structure, the drilling module substructure being shown disposed on the fixed platform support structure.
Figure 12:
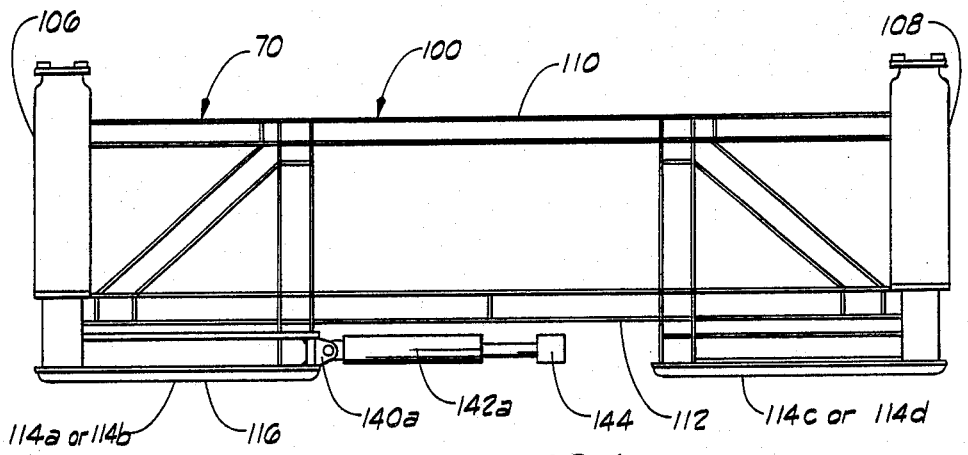
FIG. 12 is a typical side elevational view of the drilling module substructure.
Figure 13:
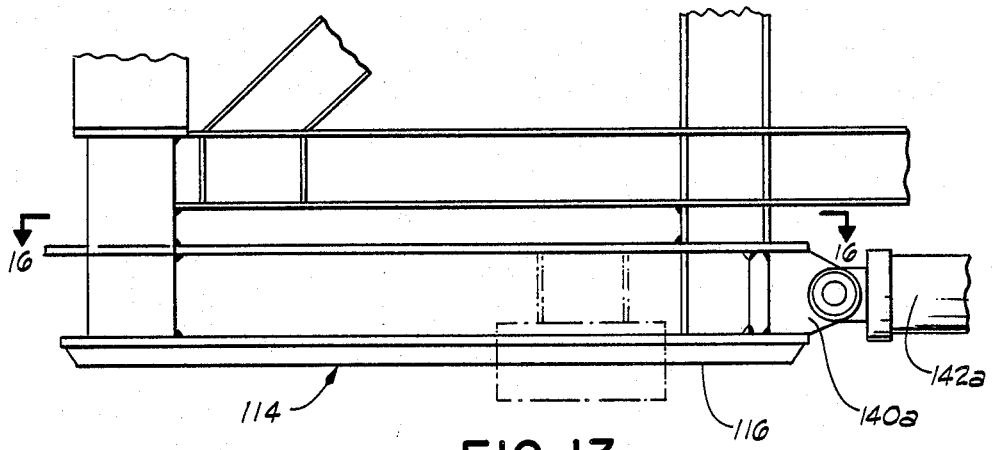
FIG. 13 is a side elevational view of a typical guide shoe portion of the drilling module substructure.
Figure 14:
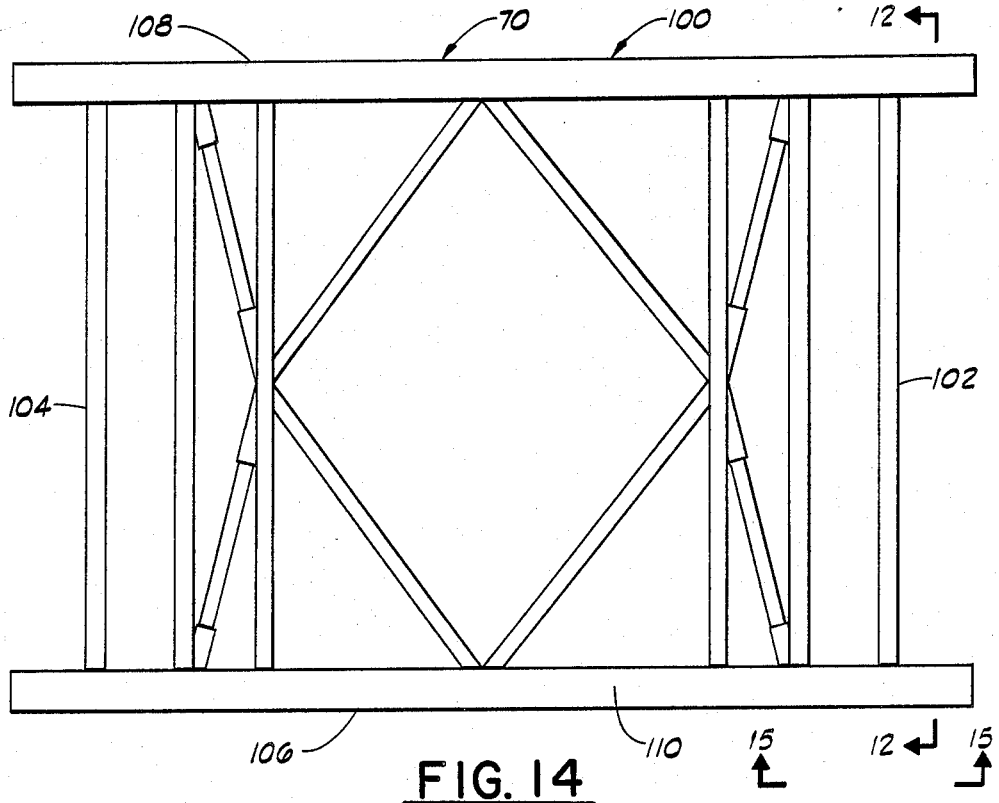
FIG. 14 is a top plan view of the drilling module substructure.
Figure 15:
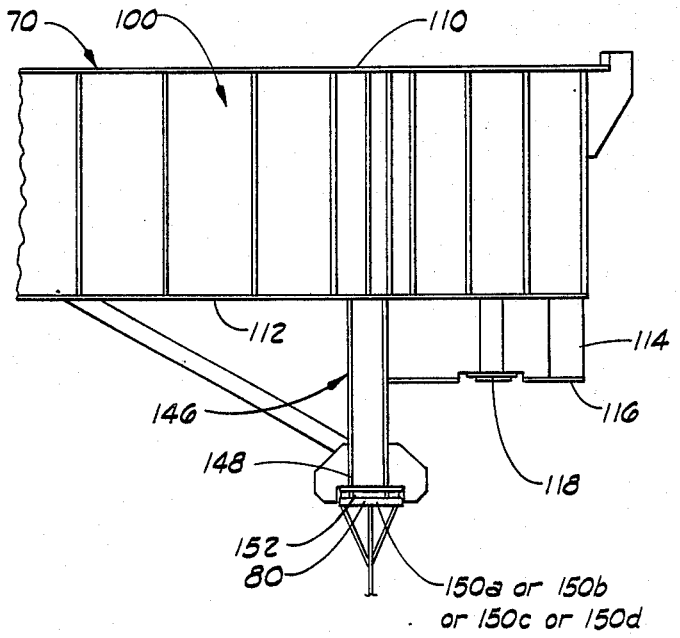
FIG. 15 is a typical end elevational view of a portion of the drilling module substructure showing a typical guide shoe and a typical beam support structure.

The drilling module substructure 70 is shown in detail in FIGS. 11–17. As shown in FIG. 14, the drilling module substructure 70 comprises a base 100 having a first side 102, a second side 104, a front end 106, a rear end 108, an upper surface 110 and a lower surface 112 (FIGS. 11 and 15). The drilling module 32 is supported on the upper surface 110 of the drilling module substructure 70.

As shown in FIGS. 11, 12, 13, 14, 15 and 16, the drilling module substructure 70 includes four guide shoe structures 114. The individual guide shoe structures 114 are designated in the drawings by the reference numerals 114*a*, 114*b*, 114*c* and 114*d*. One of the guide shoe structures 114*a* is located near the first side 102 and near the front end 106, one of the guide shoe structures 114*b* is located near the second side 104 and near the front end 106, one of the guide shoe structures 114*c* is located near the second side 104 and near the rear end 108 and one of the guide shoe structures 114*d* is located near the rear end 108 and near the first side 102. The guide shoe structures 114 are identical in construction and operation.

Each guide shoe structure 114 is connected to the lower surface 112 of the drilling module substructure 70. Each guide shoe structure 114 extends a distance from the lower surface 112 of the drilling module substructure 70 terminating with a outer end 116 (FIGS. 11, 12, 13 and 15). A guide shoe 118 (FIGS. 11 and 15)

is connected to the outer end 116 of each guide shoe structure 114.

The ends of the guide shoes 118 cooperate to form the lower substructure support surface 80. The lower substructure support surface 80 is disposable on the drilling module support surface 30 of the fixed platform support structure 16. More particularly, when the drilling module 32 is disposed on the fixed platform support structure 16, the guide shoes 118 engage the drilling module support surface 30, with two of the guide shoes 118 being disposed on the upper end of the first beam 82 and with two of the guide shoes 118 being disposed on the upper end of the second beam 84.

The outer ends 116 of the guide shoe structures 114 are extended and provide a support surface. If the drilling module 32 initially is misaligned with the beams 82 and 84, the drilling module 32 is supported on the beams 82 and 84 via the outer ends 116 while the drilling module 32 is moved into the aligned position.

Figure 18:
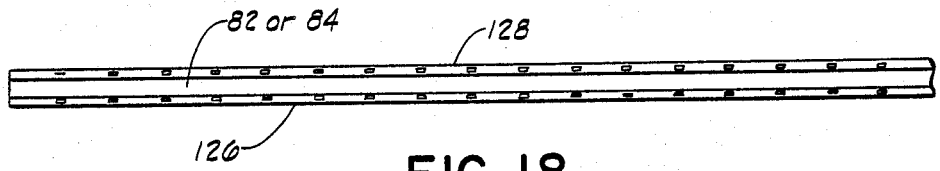
FIG. 18 is a top plan view of a typical beam of the fixed platform support structure showing two restraining bars secured to an upper surface thereof for restraining lateral movement of the drilling module when the drilling module is disposed on the fixed platform support structure.
Figure 19:
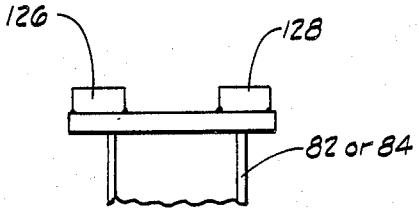
FIG. 19 is an end elevational view of the beam shown in FIG. 18.
Figure 20:
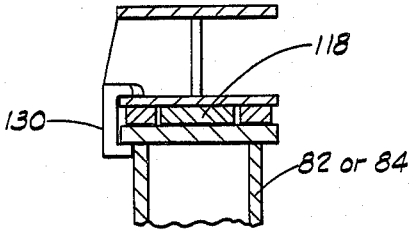
FIG. 20 is a sectional view showing a typical clamp means for retraining tilting movement and movement in forward and rearward directions of the drilling module on the fixed platform support structure.

After the drilling module substructure 70 is disposed on the fixed platform support structure 16, a pair of restraining bars 126 and 128 are connected to the upper ends of the first and the second beams 82 and 84. More particularly, each of the first and the second beams 82 and 84 includes a first restraining bar 126 (FIGS. 18 and 19) which is secured to the upper ends of the respective first and second beams 82 and 84. Each of the beams 82 and 84 also includes a second restraining bar 128 (FIGS. 18 and 19). The restraining bars 128 are secured to the respective upper ends of the first and second beams 82 and 84. The restraining bars 126 and 128 are disposed on opposite sides of the guide shoes 118 (FIG. 20). The restraining bars 126 and 128 cooperate with the guide shoes 118 to restrain lateral movement of the drilling module substructure 70 and the drilling module 32 connected hereto in directions generally toward the first side 22 and generally toward the second side 24 of the fixed platform support structure 16.

A plurality of clamps 130 (a typical clamp being shown in FIG. 20) are connected to the beams 82 and 84 and to the drilling module substructure 70 after the drilling module 32 has been disposed on the fixed platform support structure 16. The clamps 130 cooperate to restrain tilting movement of the drilling module 32 and to restrain movement of the drilling module 32 in forward and rearward directions.

Figure 16:
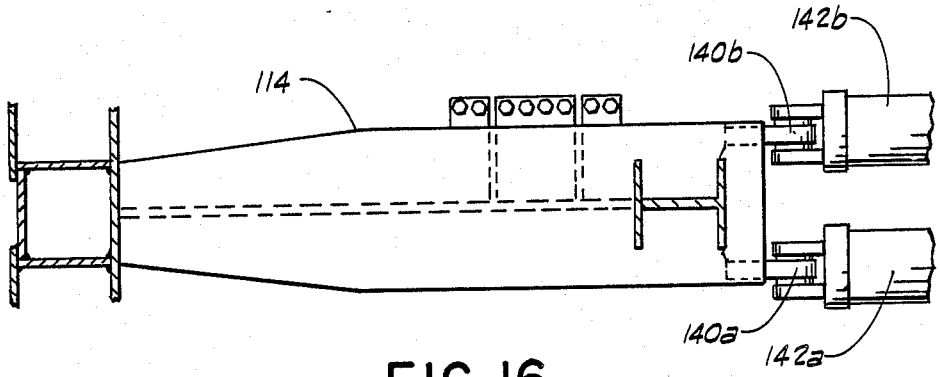
FIG 16 is a view of a portion of the drilling module substructure, taken substantially along the lines 16—16 of FIG. 13.

(As shown in FIGS. 12, 13 and 16) a pair of ears 140*a* and 140*b* are connected to each of the guide shoes 114*a* and 114*b*. A pair of hydraulic cylinders 142*a* and 142*b* are connected to the respective ears 140*a* and 140*b* via spherical bearings. Each of the hydraulic cylinders 140*a* and 140*b* are connected to a pad 144 (FIG. 12).

The pads 144 connected to the hydraulic cylinders 142*a* and 142*b* associated with the guide shoe 114*a* is connectable to the upper end of the first beam 82. The pad 144 connected to the hydraulic cylinders 142*a* and 142*b* associated with the guide shoe 114*b* is connectable to the upper end of the second beam 84. By actuating the hydraulic cylinders 142*a* and 142*b*, the drilling module substructure 70 and the drilling module 32 connected thereto is moveable in directions generally toward the front end 106 and generally toward the rear end 108 of the fixed platform support structure 16.

In lieu of connecting the hydraulic cylinders 142*a* and 142*b* to the fixed platform support structure 16, such hydraulic cylinders 142*a* and 142*b* can be connected to other portions of the fixed platform 10 for moving the fixed platform support structure 16 in different directions. If the drilling module 32 initially is positioned on the fixed platform support structure 16 at an angle, the hydraulic cylinders 142*a* and 142*b* can be used to move the drilling module substructure 70 with the drilling module 32 connected thereto to an aligned position on the fixed platform support structure 16.

Figure 17:
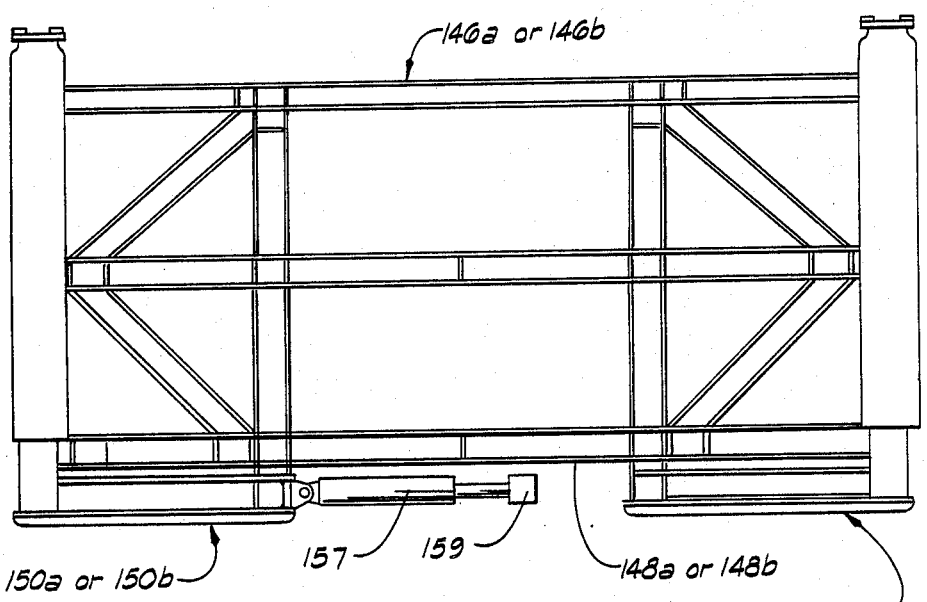
FIG. 17 is a side elevational view of a typical beam support frame of the drilling module substructure.

As shown in FIGS. 11, 15 and 17, the drilling module substructure 70 includes a pair of beam support frames 146*a* and 146*b*. The beam support frames 146*a* and 146*b* are identical in construction. One end of each beam support frame 146*a* and 146*b* is secured to lower surface 112 of the base 100 and each beam support frame 146*a* and 146*b* extends a distance from the lower surface 112 of the base 100 terminating with a lower end 148*a* and 148*b*, respectively.

Each beam support frame 146 includes a pair of guide shoes 150. Each of the guide shoes 150 is connected to the lower end 148 of the beam support frame 146. The four individual guide shoes 150 are designated in FIGS. 11 and 15 by the respective reference numerals 150*a*, 150*b*, 150*c* and 150*d*. The guide shoes 150*a* and 150*b* are disposed generally near the front end 106 of the drilling module substructure 70 and the guide shoes 150*c* and 150*d* are disposed generally near the rear end 108 of the drilling module substructure 70. The guide shoes 150*a* and 150*d* are connected to the beam support frame 146*a* and the guide shoes 150*b* and 150*c* are connected to the beam support frame 146*b*. The guide shoes 150 are identical in construction and operation.

Two of the guide shoes 150 are connected to each of the beam support frames 146 and each of the guide shoes 150 extends a distance from the lower end 148 of one of the beam support frames 146 terminating with an outer end 152 (FIG. 15). The ends 152 of the guide shoes 150 cooperate to form a lower beam support surface 81.

In operation, the drilling module substructure 70 is positioned on the cantilever beams 60 and 62 in a position wherein the drilling module substructure 70 and the drilling module 32 are supported on the cantilever beams 62 and 64 via the guide shoes 150 and the beam support surface 68 engages the lower beam support surface 81. The lower beam support surface 81 is disposed in a horizontal plane generally below the horizontal plane in which the lower substructure support surface 80 is disposed.

Figure 21:
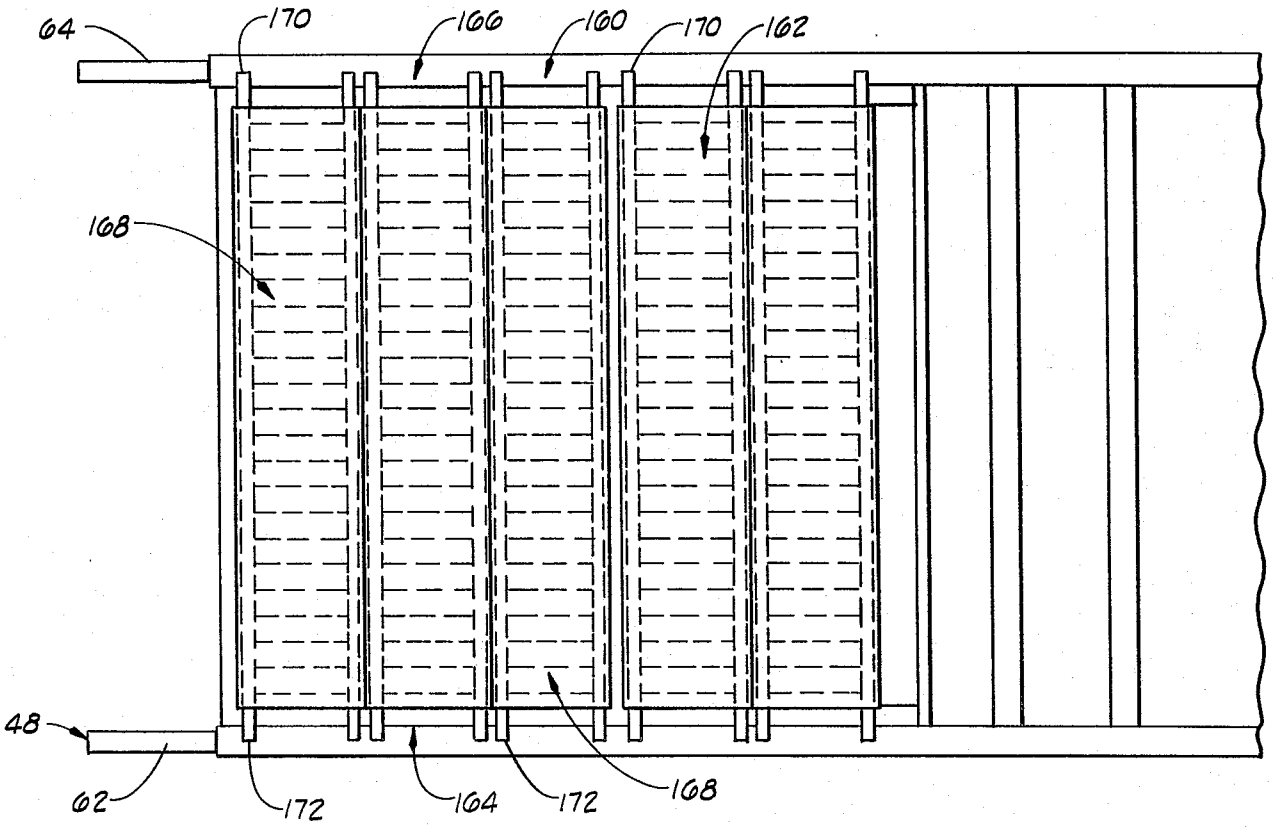
FIG. 21 is a top plan view of a floor assembly showing a removeable, floor which is supported generally under the drilling module when the drilling module has been removed from the cantilever beam assembly.
Figure 22:
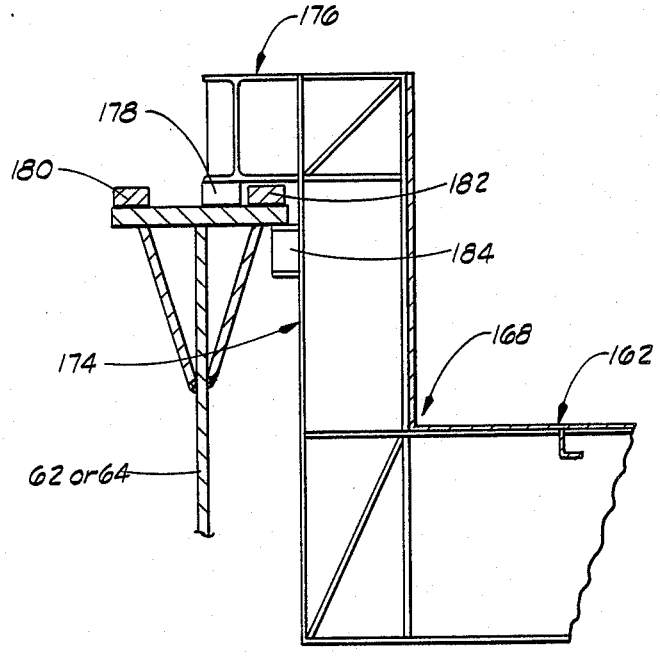
FIG. 22 is a cross a sectional view showing a typical floor support for removably supporting the floor of the floor assembly shown in FIG. 21 on the cantilever beam assembly and generally under the drilling module.

In one embodiment, the present invention also contemplates a removable floor assembly 160, as shown in FIGS. 21 and 22 which is supported on the cantilever beams 62 and 64 and disposed generally under the drilling module substructure 70. The removable floor assembly comprises a floor 162 which extends between the cantilever beams 62 and 64 and extends a distance generally from the rearward end 48 of the cantilever beam assembly 42 generally toward the forward end 50 thereof. The floor 162 has opposite sides 164 and 166.

The floor assembly 160 comprises a plurality of floor members 168. Each of the floor members 168 is identical in construction and operation and only two of the floor members 168 are designated by reference numerals in FIG. 21. Each floor member 168 has opposite ends 170 and 172.

A pair of floor supports 174 (FIG. 22) are connected the end 170 and another pair of floor supports 174 are connected to the end 172 of each of the floor members 168. The floor supports 174 are identical in construction and operation and a typical floor support 174 is shown in FIG. 22.

Each floor support 174 extends a distance from the end 170 or 172 of one of the floor members 168 in a generally upwardly direction. An overhang 176 is formed on one end of each of the floor support 174. The overhang 176 extends a distance generally over the upper end of one of the cantilever beams 62 or 64. A stop 178 is connected to the overhang 176 and the stop 178 is generally disposed on the upper end of the cantilever beams 62 or 64.

A pair of restraining bars 180 and 182 are secured to the upper end of each of the cantilever beams 62 and 64. The stop 178 is engageable with the restraining bar 182 for cooperating to secure the floor assembly 160 in a position connected to the cantilever beams 62 or 64. A second stop 184 is removably secured to the floor support 174. The second stop 184 is positioned to engage a portion of the cantilever beam 62 or 64. The stops 178 and 184 cooperate to secure the removable floor assembly 160 connected to the cantilever beams 62 and 64. When it is desired to remove the floor assembly 160 from the cantilever beam assembly 42, it is necessary to remove the second stops 184.

It should be noted that the restraining bars 180 and 182 on the cantilever beams 62 and 64 cooperate to engage the bars 156 of the guide shoes 150 to restrain lateral movement of the drilling module substructure 70 when the drilling module substructure 70 with the drilling module 32 supported thereon is disposed on the cantilever beams 62 and 64.

Figure 23:
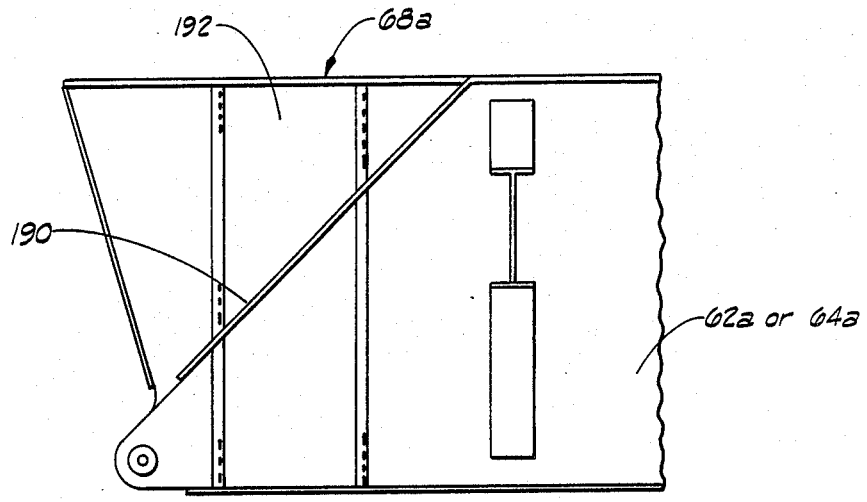
FIG. 23 is a side elevational view of a forward end portion of a typical cantilever beam showing a beam extension connected thereto.

Some existing cantilever beams include a tapered forward end. In some applications, it may be desired to extend the effective surface of the cantilever beams to provide an additional length. Shown in FIG. 23 is a cantilever beam 62*a* or 64*a* having a tapered rearward end 190. A beam extension 192 is secured to the cantilever beam 62*a* or 64*a* to extend the beam support surface 68*a*.

Figure 24:
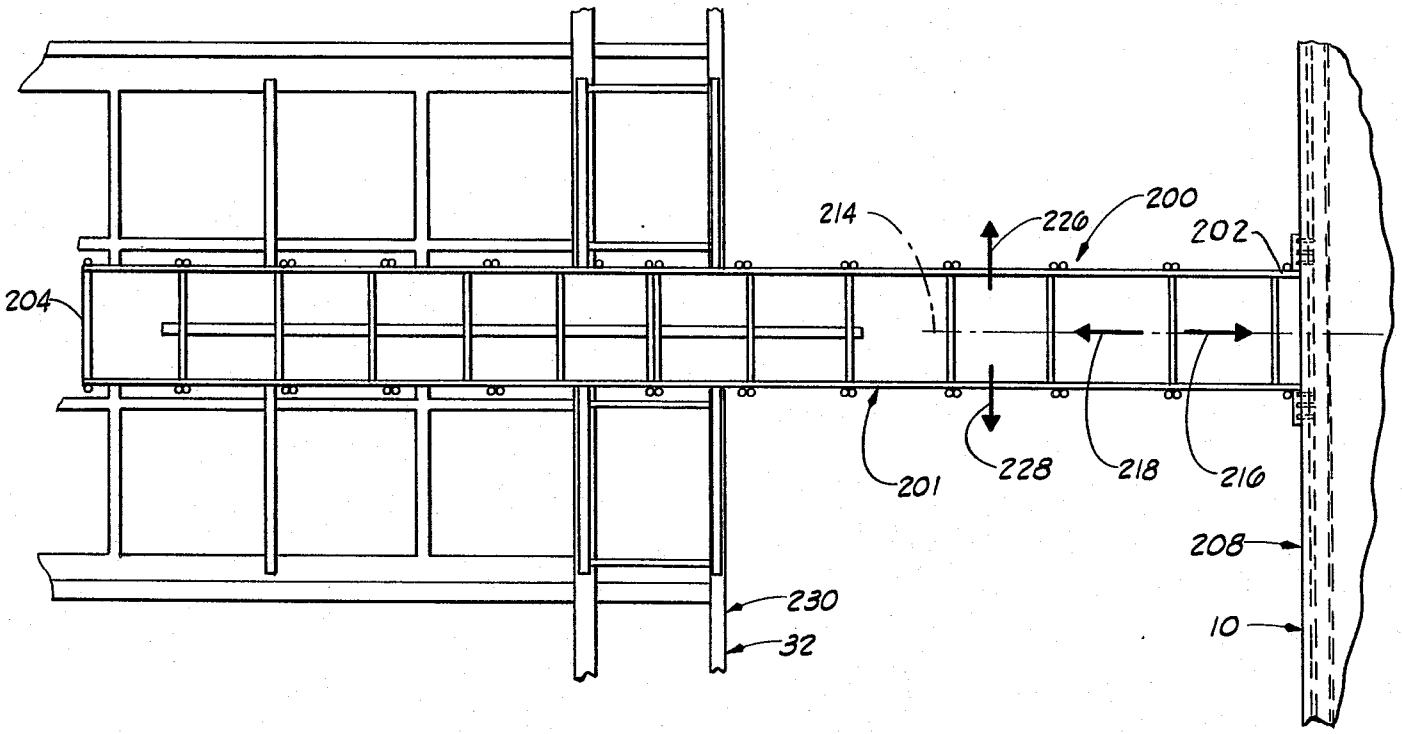
FIG. 24 is a top plan view showing a dragway bridge assembly movably connected to the fixed platform (partially shown in FIG. 24) and movably connected to the jack-up rig (partially shown in FIG. 24).
Figure 25:
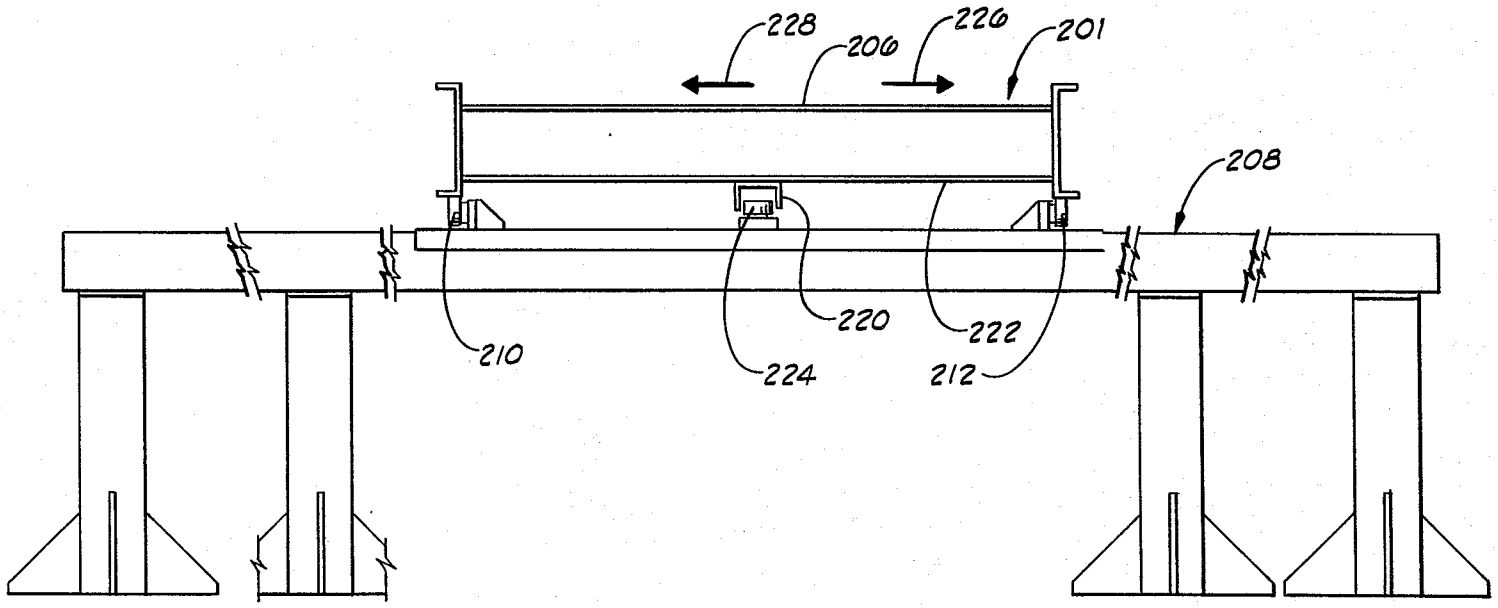
FIG. 25 is an end elevational view showing a portion of the bridge of the dragway bridge assembly movably connected to the fixed platform.
Figure 27:
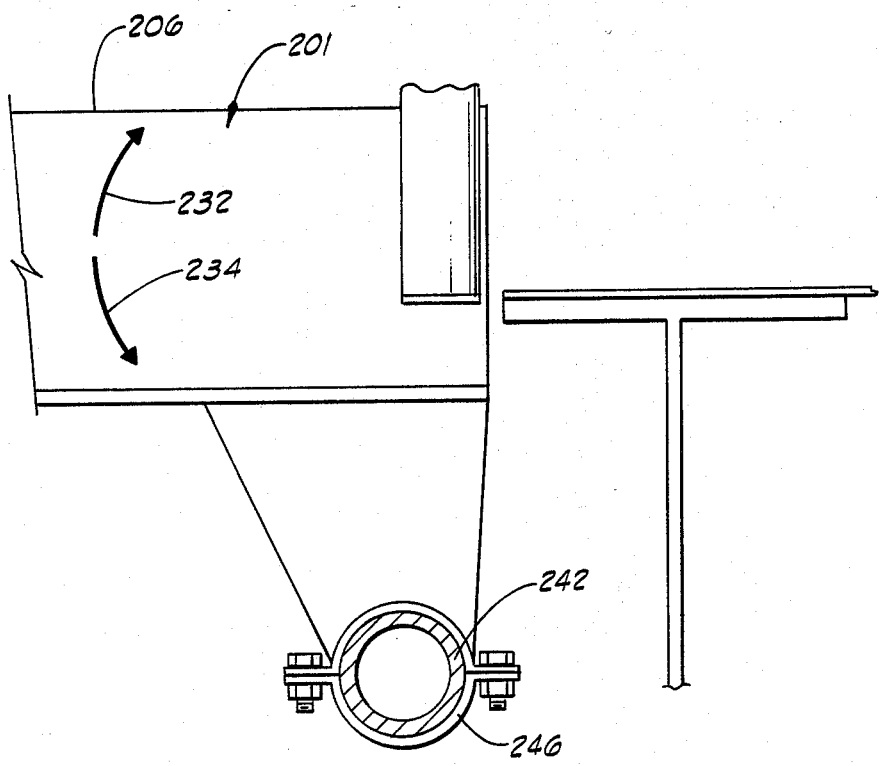
FIG. 27 is a side elevational view, partial sectional view showing another portion of the connection of the bridge to the jack-up rig.

Shown in FIGS. 24, 25 and 27 is a dragway bridge assembly 200 having a first end 202, a second end 204 and an upper surface 206 forming a bridge surface. After the drilling module 32 has been disposed on the fixed platform 10 and the cantilever beam assembly 42 has been moved to the storage position, it is convenient to have a bridge extending between the fixed platform 10 and the jack-up rig 34 so that pipe and other drilling materials may be pulled from the jack-up rig 34 across the bridge and moved onto the fixed platform 10 for example. The dragway bridge assembly 200 is provided for such purposes.

Shown in FIG. 25 is a structure portion 208 of the fixed platform 10. A pair of rollers 210 and 212 are rollingly supported on the structure portion 208. The roller 210 rollingly engages one side of the bridge 201 and the roller 212 rollingly engages the opposite side of the bridge 201. The bridge 201 thus is rollingly supported on the fixed platform 10 for movement along a bridge axis 214 (FIG. 24) extending generally between the first and second ends 202 and 204 of the bridge 201. The bridge 201 more particularly movably supported on the fixed platform 10 for movement in a first direction 216 (FIG. 24) and in an opposite second direction 218 (FIG. 24).

As shown in FIG. 25, a channel 220 is connected to a lower surface 222 of the bridge 201. A third roller 224 is rollingly supported on the structure portion 208. The third roller 224 is disposed generally in the channel 220 and positioned to rollingly engage the opposite sides of the channel 224. The third roller 224 cooperates with the channel 220 to limit movement of the bridge 201 generally at the connection of the bridge 201 to the fixed platform 10 in directions generally perpendicular to the bridge axis 214 or, more particularly, to limit movement of the bridge 201 in a first direction 226 and in an opposite second direction 228 (shown in FIGS. 24 and 25).

The bridge 201 is connected to a structure portion 230 (FIG. 24) of the jack-up rig 34 in such a manner that the bridge 201 is moveable generally at the connection between the bridge 201 and the jack-up rig 34 in the lateral directions 226 and 228 generally perpendicular to the bridge axis 214 and such that the bridge 201 is pivotally moveable in a generally upwardly direction 232 (FIG. 27) and in a generally downwardly direction 234 (FIG. 27).

Figure 26:
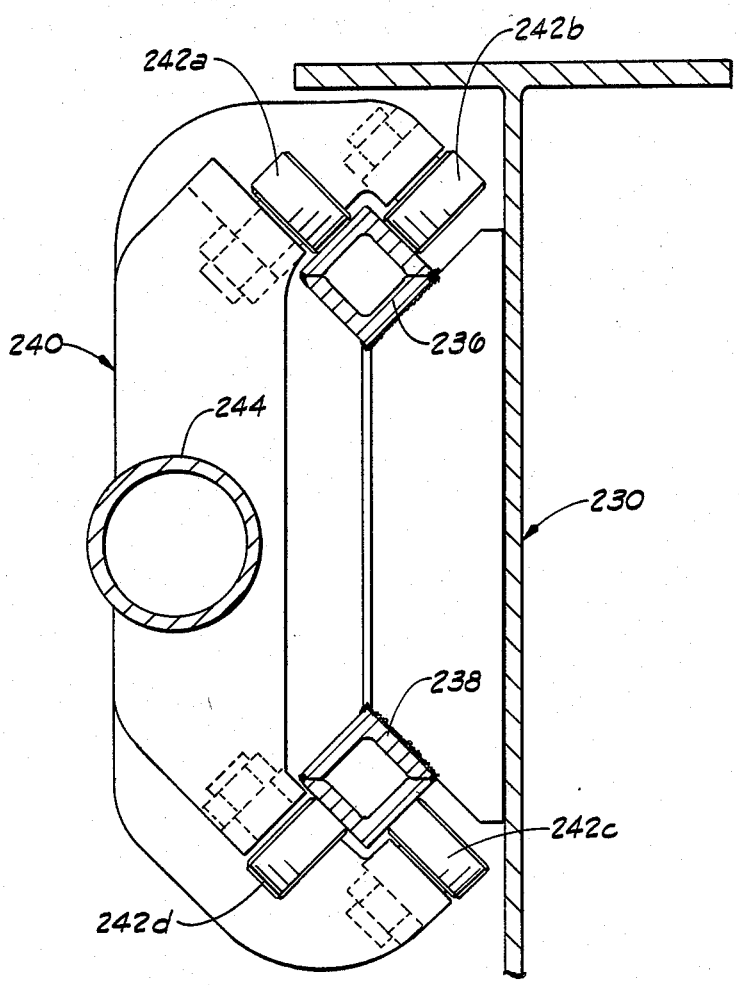
FIG. 26 is a partial sectional, partial elevational view showing the roller assembly for connecting the bridge to the jack-up rig.

As shown in FIG. 26, a pair of square pipes 236 and 238 are connected to the structure portion 230 and the pipes extend a distance generally along the structure portion 230 in the directions 226 and 228. A roller assembly 240 is connected to the lower surface 222 of the bridge 201. The roller assembly 240 includes a plurality of rollers 242 (four rollers being shown in FIG. 26 and designated therein by the reference numerals 242*a*, 242*b*, 242*c* and 242*d*). Two of the rollers 242*a* and 242*b* rollingly engage the pipe 236 and the other two rollers 242*c* and 242*d* rollingly engage the pipe 238. The bridge 201 thus is moveable in the lateral directions 226 and 228 via the rolling engage between the rollers 242 and the pipes 236 and 238.

As shown in FIGS. 26 and 27, a pipe 244 extends outwardly from the roller assembly 240. The bridge 201 is pivotally connected to the pipe 242 via a bearing 246 thereby permitting the bridge 201 to be moved in the directions 232 and 234.

Changes may be made in the construction and the operation of the various components, elements and assemblies described herein and changes may be made in the steps or the sequence of steps of the methods described herein without departing from the spirit and scope of the invention as defined in the following claims.

What is claimed is:

1. A method for transferring a drilling module from a jack-up rig to a fixed platform wherein the fixed platform comprises legs secured to an ocean floor and wherein the jack-up rig comprises telescoping legs movable in upwardly and downwardly directions and wherein a portion of the jack-up rig is moveable in upwardly and downwardly directions and a cantilever beam assembly having a rearward end and means for moving the cantilever beam assembly from a storage position wherein the cantilever beam assembly is supported generally on the jack-up rig to extended positions wherein the rearward end portion of the cantilever beam assembly is extended distances generally from the jack-up rig, the method comprising:

supporting the drilling module on the cantilever beam assembly;

positioning the jack-up rig near the fixed platform;

moving the cantilever beam assembly with the drilling module supported thereon to an extended position wherein the drilling module is supported generally over a portion of the fixed platform; and removing the drilling module from the cantilever beam assembly and supporting the drilling module on the fixed platform.

2. The method of claim 1 further comprising:

moving the cantilever beam assembly, after removing the drilling module therefrom, to the storage position.

3. The method of claim 1 further comprising:

connecting a fixed platform support structure to the fixed platform wherein the fixed platform support structure comprises a drilling module support surface; and wherein the step of removing the drilling module and supporting the drilling module on the fixed platform is further defined as removing the drilling module from the cantilever beam assembly and supporting the drilling module on the support surface of the fixed platform support structure.

4. The method of claim 1 wherein the drilling module includes a lower substructure support surface and wherein the cantilever beam assembly includes a beam support surface, and wherein the method further comprising:

connecting a fixed platform support structure to the fixed platform wherein the fixed platform support structure comprises a drilling module support surface, a front end, a rear end and a beam opening extending through the front end of the fixed platform support structure and extending a distance generally toward the rear end of the fixed platform support structure; and wherein the step of positioning the jack-up rig near the fixed platform is further defined as positioning the jack-up rig near the fixed platform with the cantilever beam assembly being generally aligned with the beam opening in the fixed platform support structure and with the lower substructure support surface of the drilling module being disposed in a horizontal plane spaced a distance generally above a horizontal plane in which the drilling module support surface of the fixed platform support structure is disposed; and wherein the step of moving the cantilever beam assembly to the extended position is further defined as moving the cantilever beam assembly with the drilling module supported thereon from the jack-up rig and through at least a portion of the beam opening in the fixed platform support structure to a position wherein the lower substructure support surface of the drilling module or is disposed a distance generally above the drilling module support surface of the fixed platform support structure; and wherein the step of removing the drilling module from the cantilever beam assembly further comprises:

lowering the jack-up rig in a generally downwardly direction to lower the cantilever beam assembly to a position wherein the lower substructure support surface of the drilling module is disposed generally on the drilling module support surface of the fixed platform support structure and further lowering the jack-up rig to lower the cantilever beam assembly to a position wherein the beam support surface is spaced a distance generally below the lower substructure support surface of the drilling module thereby disconnecting the cantilever beam assembly from the drilling module.

5. The method of claim 4 wherein the drilling module includes a lower beam support surface and wherein the step of removing the drilling module from the fixed platform, further comprises:

extending the cantilever beam assembly from the jack-up rig and through a portion of the beam opening in the fixed platform support structure to a position wherein the lower beam support surface of the drilling module is disposed a distance generally above the beam support surface of the cantilever beam assembly;

raising the jack-up rig in a generally upwardly direction to raise the cantilever beam assembly to a position wherein the beam support surface engages the lower beam support surface and further raising the cantilever beam assembly to a position wherein the lower beam support surface of the drilling module is supported on the beam support surface of the cantilever beam assembly thereby disconnecting the drilling module from the fixed platform support structure; and moving the cantilever beam assembly with the drilling module disposed thereon to the storage position.

6. The method of claim 5 wherein, prior to extending the cantilever beam assembly, the step of removing the drilling module from the fixed platform further comprises:

positioning the jack-up rig near the fixed platform with the cantilever beam assembly being generally aligned with the beam opening in the fixed platform support structure and with the beam support surface being disposed in a horizontal plane spaced a distance below a horizontal plane in which the drilling module support surface of the fixed platform support structure is disposed and generally below a horizontal plane in which the lower beam support surface of the drilling module is disposed 7. The method of claim 4 wherein the fixed platform support structure comprises a first side and a second side, and wherein, after the drilling module is disposed on the drilling module support surface of the fixed platform support structure, the method further comprises:

restraining movement of the drilling module on the drilling module support surface in directions generally toward the first side of the fixed platform support structure and generally toward the second side of the fixed platform support structure.

8. The method of claim 7 wherein, after the drilling module is disposed on the fixed platform support structure, the method further comprises:

restraining tilting movement of the drilling module on the drilling module support surface and restraining movement of the drilling module in forward and rearward directions.

9. The method of claim 4 wherein the fixed platform support structure comprises a first side and a second side, and wherein, after the drilling module is disposed on the drilling module support surface of the fixed platform support structure, the method further comprises:

restraining tilting movement of the drilling module on the drilling module support surface and restraining movement of the drilling module in forward and rearward directions.

10. The method of claim 4 wherein the step of disposing the drilling module on the drilling module support surface is further defined as movably disposing the drilling module on the drilling module support surface for movement of the directions generally toward the front end of the fixed platform support structure and generally toward the rear end of the fixed platform support structure.

11. The method of claim 1 wherein the cantilever beam assembly includes a forward end and a beam support surface, and wherein the step of supporting the drilling module on the cantilever beam assembly is further defined as supporting movably the drilling module on the beam support surface for movement of the drilling module on the beam support surface in a direction generally toward the forward end of the cantilever beam assembly and for movement of the drilling module on the beam support surface in a direction generally toward the rearward end of the cantilever beam assembly.

12. An apparatus for transferring a drilling module having a lower substructure support surface from a jack-up rig to a fixed platform wherein the fixed platform comprises legs secured to an ocean floor and wherein the jack-up rig comprises telescoping legs movable in upwardly and downwardly directions and wherein a portion of the jack-up rig is moveable in generally upwardly and downwardly directions and a cantilever beam assembly having a rearward end and a beam support surface and means for moving the cantilever beam assembly from a storage position wherein the cantilever beam assembly is supported generally on the jack-up rig to extended positions wherein the rearward end portion of the cantilever beam assembly is extended distances generally from the jack-up rig, the apparatus comprising:

a fixed platform support structure connected to the fixed platform having a drilling module support surface, a front end, a rear end, a first side and a second side; and means for supporting the drilling module on the beam support surface of the cantilever beam assembly, said means being extendable by the cantilever beam assembly to an extended position for disposing the drilling module from the cantilever beam assembly on to the drilling module support surface of the fixed platform support structure, said means also supporting the drilling module on the drilling module support surface of the fixed platform support structure when the drilling module is transferred to the drilling module support surface.

13. The apparatus of claim 12 wherein the fixed platform support structure further comprises:

a first beam having an upper end, a first end and a second end;

a second beam having an upper end, a first end and a second end, the upper ends of the first and second beams cooperating to form the drilling module support surface; and means for connecting the first and second beams to the fixed platform with the first beam being spaced a distance from the second beam and the space between the first and second beams cooperating to form a beam opening whereby the cantilever beam assembly with the drilling module disposed thereon is extendable through the beam opening and lowerable to dispose the drilling module on the drilling module support surface.

14. The apparatus of claim 12 wherein the cantilever beam assembly includes a forward end, and wherein the means for supporting the drilling module on the cantilever beam assembly is further defined as movably supporting the drilling module on the cantilever beam assembly for movement of the drilling module on the cantilever beam assembly in one direction generally toward the forward end of the cantilever beam assembly and for movement of the drilling module on the cantilever beam assembly in one other direction generally toward the rearward end of the cantilever beam assembly, and movably supporting the drilling module on the drilling module support surface of the fixed platform support structure when the drilling module is disposed on the drilling module support surface for movement generally toward the front end of the fixed platform support structure and for movement generally toward the rear end of the fixed platform support structure.

15. The apparatus of claim 14 wherein the means for supporting the drilling module on the cantilever beam assembly comprises:

a drilling module substructure having a first end, a second end, a first side, a second side, an upper surface and a lower surface, the lower surface being disposable on the cantilever beam assembly and the drilling module being supported on the upper end of the drilling module substructure;

means connectable to the drilling module substructure and connectable to the cantilever beam assembly for moving the drilling module substructure and the drilling supported thereon generally toward the forward end and generally toward the rearward end of the cantilever beam assembly; and means connectable to the drilling module substructure and connectable to the fixed platform support structure for moving the drilling module supported thereon generally toward the front end and generally toward the rear end of the fixed platform support structure.

16. The apparatus of claim 12 wherein the means for supporting the drilling module on the fixed platform support structure, comprises:

a drilling module substructure having a first end, a second end, a first side, a second side, an upper end and a lower end, the drilling module being supported on the upper end of the drilling module substructure and the lower end being disposable on the drilling module support surface of the fixed platform support structure.

17. The apparatus of claim 16 wherein the means for supporting the drilling module on the fixed platform support structure, comprises:

restraining bar means removably connectable to the fixed platform support structure after the drilling module substructure has been disposed on the fixed platform support structure, said restraining bar means being engageable with the drilling module substructure for substantially restraining lateral movement of the drilling module substructure on the fixed platform support structure in directions generally toward the first and the second sides of fixed platform support structure.

18. The apparatus of claim 17 wherein the means for supporting the drilling module on the fixed platform support structure, comprises:

clamp means removably connectable to the fixed platform support structure and removably connectable to the drilling module substructure for restraining tilting movement of the drilling module substructure on the fixed platform support structure and for restraining movement of the fixed platform support structure in forward and rearward directions.

19. The apparatus of claim 12 wherein the fixed platform support structure is defined further as comprising a beam opening intersecting the front end and extending a distance generally toward the rear end of the fixed platform support structure, the beam opening being sized and adapted to receive the portion of the cantilever beam assembly with the drilling module disposed thereon, the cantilever beam assembly with the drilling module disposed thereon being moveable through at least a portion of the beam opening in the fixed platform support structure and positionable for cooperating to dispose the drilling module on the drilling module support surface of the fixed platform support structure.

20. The apparatus of claim 19 wherein the means for supporting the drilling module on the fixed platform support structure, comprises:

restraining bar means removably connectable to the fixed platform support structure after the drilling module has been disposed on the fixed platform support structure, said restraining bar means being engageable with the drilling module for substantially restraining lateral movement of the drilling module on the fixed platform support structure in directions generally toward the first and the second sides of fixed platform support structure.

21. The apparatus of claim 20 wherein the means for supporting the drilling module on the fixed platform support structure, comprises:

clamp means removably connectable to the fixed platform support structure and removably connectable to the drilling module for restraining tilting movement of the drilling module on the fixed platform support structure and for restraining movement of the fixed platform in forward and rearward directions.

22. The apparatus of claim 12 wherein the drilling module includes lower beam support surface and wherein the lower beam support surface is disposed on the beam support surface of the cantilever beam assembly when the drilling module is disposed on the cantilever beam assembly, and wherein the apparatus further comprises:

a floor; and means for removably supporting the floor on the cantilever beam assembly in a position wherein at least a portion of the floor is disposed generally under the drilling module when the drilling module is supported on the cantilever beam assembly and wherein the floor is disposed in a horizontal plane spaced a distance from the horizontal plane in which the lower beam support surface of the drilling module is disposed.

23. The apparatus of claim 22 wherein the floor has a first side and a second side and wherein the cantilever beam assembly comprises a first cantilever beam and a second cantilever beam spaced a distance from the first cantilever beam, and wherein the floor is disposed generally between the first and second cantilever beams, and wherein the means for removably supporting the floor on the cantilever beam assembly comprises:

a plurality of floor supports with some of the floor supports being connected to the first side of the floor and the remaining floor supports being connected to the second side of the floor, each floor support extending a distance from the floor and being removably connectable to one of the first and the second cantilever beams.

24. The apparatus of claim 23 further comprising:

means for removably connecting the floor supports to the first and second cantilever beams.

25. The apparatus of claim 12 wherein the cantilever beam assembly comprises a first cantilever beam having an upper surface and a second cantilever beam having an upper surface with the first cantilever beam being spaced a distance from the second cantilever beam, the upper surfaces of the first and second cantilever beams forming a beam support surface, and the means for supporting the drilling module on the cantilever beam assembly and on the drilling module support surface of the fixed platform support structure further comprises:

a drilling module substructure having a first end, a second end, a first side, a second side, an upper surface, and a lower surface;

four guide shoe structures with each guide shoe structure being connected to the lower surface of the drilling module substructure and each guide shoe structure extending the distance generally from the lower surface of the drilling module substructure terminating with an outer end, one of the guide shoe structures being disposed generally near the first side and generally near the first end of the drilling module substructure, one of the guide shoe structures being disposed generally near the first end and generally near the second side of the drilling module substructure, one of the guide shoe structures being disposed generally near the second end and generally near the first side of the drilling module substructure and one of the guide shoe structures being disposed generally near the second end and generally near the second side of the drilling module substructure; and four guides shoes, each guide shoe being connected to the outer end of one of the guide shoe structures, the guide shoes cooperating to form the lower substructure support surface, the lower substructure support surface being disposed on the drilling module support surface when the drilling module is disposed on the fixed platform support structure.

26. The apparatus of claim 25 wherein the means for supporting the drilling module on the cantilever beam assembly further comprises:

beam support frame means connected to the lower surface of the drilling module substructure and extending a distance therefrom terminating with a lower end; and a plurality of guide shoes connected to the lower end of the beam support frame means, each guide shoe having a recess formed in a portion thereof and means disposed in each recess for forming the drilling module support surface.

27. The apparatus of claim 26 wherein the cantilever beam assembly further comprises:

a first cantilever beam having an upper end, a first end and a second end; and a second cantilever beam having an upper end, a first end and a second end, the upper ends of the first and second cantilever beams cooperating to form the beam support surface; and wherein some of the guide shoes forming the lower beam support surface are supported on the upper end of the first cantilever beam and wherein the remaining guide shoes are supported on the upper end of the second cantilever beam when the drilling module substructure with the drilling module supported thereon is disposed on the cantilever beam assembly.

28. The apparatus of claim 27 further comprising:

means for restraining lateral movement of the drilling module substructure and the drilling module supported thereon on the first and the second cantilever beams when the drilling module substructure is supported on the first and second cantilever beams.

29. The apparatus of claim 26 wherein the lower beam support surface is disposed in a horizontal plane disposed generally below a horizontal plane in which the lower substructure support surface is disposed.

30. The apparatus of claim 25 wherein the outer end of the guide shoe structures defines a supporting surface, and wherein the outer ends of the guide shoe structures are supportable on the drilling module support surface to compensate for misalignment of the rig substructure on the fixed platform support structure and to support the rig substructure on the fixed platform support structure while the rig substructure is moved into alignment with the lower substructure support surface supported on the drilling module support surface.

31. The apparatus of claim 25 further comprising:

means for restraining lateral movement of the drilling module substructure and the drilling module supported thereon on the fixed platform support structure when the drilling module substructure is supported on the fixed platform support structure.

* * * * *